US008646207B1

(12) United States Patent
Lankford

(10) Patent No.: US 8,646,207 B1
(45) Date of Patent: Feb. 11, 2014

(54) SELF-CLOSING ENTRY SYSTEM

(76) Inventor: Mark Lankford, Tyler, TX (US)

( * ) Notice: Subject to any disclaimer, the term of this patent is extended or adjusted under 35 U.S.C. 154(b) by 0 days.

(21) Appl. No.: 13/570,582

(22) Filed: Aug. 9, 2012

(51) Int. Cl.
*E01F 13/00* (2006.01)

(52) U.S. Cl.
USPC ..... 49/49; 49/273; 49/274; 49/394; 49/236; 49/386

(58) Field of Classification Search
USPC ..... 49/49, 263, 266, 273, 274, 394, 236, 49/237, 238, 239, 364, 386, 384; 256/73
See application file for complete search history.

(56) References Cited

U.S. PATENT DOCUMENTS

| | | | | | |
|---|---|---|---|---|---|
| 189,300 | A * | 4/1877 | Breakey | 49/238 |
| 225,512 | A * | 3/1880 | Doolittle | 49/238 |
| 235,113 | A * | 12/1880 | Young | 49/236 |
| 629,447 | A * | 7/1899 | Jensen | 110/176 |
| 1,007,306 | A * | 10/1911 | Nevins et al. | 292/93 |
| 1,126,067 | A * | 1/1915 | Nolte | 16/307 |
| 1,383,961 | A * | 7/1921 | Melugin | 16/314 |
| 1,471,830 | A * | 10/1923 | Corey | 16/72 |
| 1,663,152 | A * | 3/1928 | Baeth | 292/93 |
| 1,800,165 | A * | 4/1931 | Waldron | 49/236 |
| 2,086,061 | A * | 7/1937 | Barr | 49/237 |
| 2,587,287 | A * | 2/1952 | Chamberlain | 16/72 |
| 2,629,191 | A | 2/1953 | Koch et al. | |
| 2,693,653 | A * | 11/1954 | Dean, Jr. | 49/238 |
| 2,713,737 | A * | 7/1955 | Hawkins | 49/271 |
| 2,742,722 | A | 4/1956 | Schaefer | |
| 3,193,955 | A | 7/1965 | Pitts | |
| 3,377,746 | A * | 4/1968 | Thomas | 49/242 |
| 3,497,996 | A | 3/1970 | Stevens | |
| 3,683,554 | A | 8/1972 | Romberg | |
| 3,775,912 | A * | 12/1973 | Walls | 49/131 |
| 4,145,842 | A | 3/1979 | Clugston | |
| 4,205,472 | A * | 6/1980 | Shirley | 40/608 |
| 5,133,152 | A * | 7/1992 | Grancagnolo | 49/239 |
| 5,138,796 | A | 8/1992 | Grainger | |
| 6,349,503 | B1 * | 2/2002 | Gompertz et al. | 49/34 |
| 6,988,719 | B2 * | 1/2006 | Ursell et al. | 269/289 MR |
| 2011/0193041 | A1 * | 8/2011 | Stull | 256/73 |

* cited by examiner

*Primary Examiner* — Katherine Mitchell
*Assistant Examiner* — Shiref Mekhaeil
(74) *Attorney, Agent, or Firm* — Eric C Schmalbach

(57) ABSTRACT

A self-closing entry system includes an entrance, a base support member located at one side of the entrance, a bearing arrangement attached to the base support member, a gate surface member pivotably mounted to the base support member, a bumper assembly defined by at least one bumper frame member pivotably fastened to the gate surface member at a gate fulcrum, at least one bumper contact element fastened to the at least one bumper frame member, and wherein the at least one bumper contact element is capable of axial rotation about the at least one bumper frame member, a counterbalance assembly extending from the first bumper frame member to the second bumper frame member, and a means for latching the gate system, allowing the gate surface member to move in one direction upon activation of a latching control means.

15 Claims, 49 Drawing Sheets

SELF-CLOSING ENTRY SYSTEM

BACKGROUND

Regulated and time-efficient passage through an entrance continues to be a problem. Entry systems traditionally provide a means of passage to a closed, or fenced in area. Such entry systems are typically maintained in a closed and latched position to prohibit or restrict entrance. Operation of entry systems often requires egress of a driver from a vehicle to operate the entry system. The driver must exit the vehicle to operate the entry system, thereby expending time during operation.

Self-regulating gating systems are known which employ bumper assemblies activated by a vehicle. However, bumper assemblies may strike or damage a vehicle during passage. Bumper assemblies can often be unintentionally activated by wind or livestock. Moreover, the excess weight of bumper assemblies can exert increased load pressures on hinge assemblies, resulting in malfunction and/or damage. Therefore, a need exists for an improved self-closing entry system which allows regulated and time-efficient passage through an entrance.

SUMMARY

The present invention is directed towards an improved self-closing entry system for regulated and time-efficient passage through an entrance. The self-closing entry system includes an upright support post, which has an at least one cam surface. A post member is concentrically disposed within the upright support post, extending at an opposing end to a receiver member. At least one bearing member extends from the post member as follower to the cam surface. A hinge post extends parallel with the upright support post, separated a distance from the upright support post, and inserted at its upper end into the receiver member. A longitudinally extending entrance member (such as a gate, or cattle guard, for example) extends longitudinally perpendicular from the hinge post, supported by a support arm, which is inserted into the receiver member. A hinge bearing structure is located between the hinge post and upright support member. The upright support post is filled with a fluid. A bumper assembly defines a first bumper frame member attached to a fulcrum, a first bumper contact element capable of independent axial rotation in relation to the first bumper frame member, a second bumper frame member attached to the fulcrum, a second bumper contact element capable of independent axial rotation in relation to the second bumper frame member. The first bumper frame member and second bumper frame member exist as a contiguous assembly, forming a lever capable of rotation about the fulcrum, as a continuous force is applied to either of the first bumper contact element or second bumper contact element in during opening of the entry system. A counter-balance assembly extends from the first bumper frame member to the second bumper frame member, causing opposing axial rotation between the first bumper frame member and the second bumper frame member. The counter-balance assembly further causes the first bumper frame member to maintain a first central angle between the entrance member which approximately equivalent to a second central angle between the second bumper frame member and the entrance member. A reset mechanism extends between the entrance member and bumper assembly, causing the position of the bumper assembly relative to the entrance member to reset when the force is removed from either the first bumper contact element or second bumper contact element. A means for latching the entry system allows the entrance member to move in one direction upon activation of a latching control means.

BRIEF DESCRIPTION OF THE DRAWINGS

These and other features, aspects and advantages of embodiments of the invention will become better understood with regard to the following description, appended claims, and accompanying drawings where:

DETAILED DESCRIPTION

Figure 1:
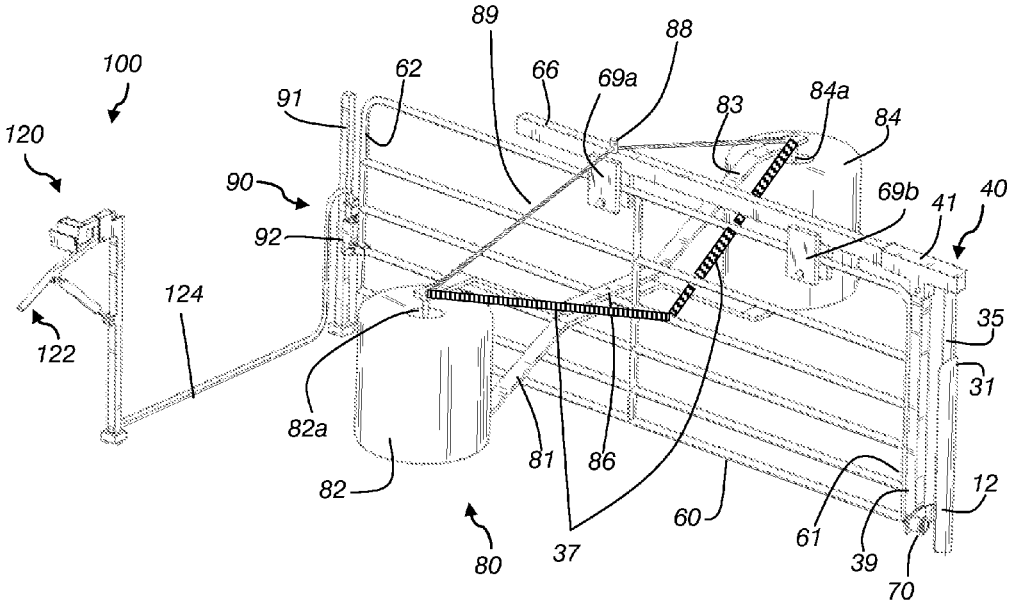
FIG. 1 is a perspective view of a self-closing entry system of an embodiment of the invention.

Referring to FIGS. 1-4, upright support post 12 extends longitudinally perpendicular relative to the ground. Upright support post 12 is a hollow rigid body, and is fixedly set into a foundation member 14. Foundation member 14 is fixedly set into the ground. Upper cam surface 31 is located at the upper terminus of upright support post 12, presenting an upwardly helical surface, serving as a cam body. Post member 35 is a longitudinally extending member, concentrically disposed within upright support post 12 at one end of the post member 35, and into a receiver member 40 at an opposing end of the post member 35. Roller bearing 36 is fixedly attached to post member 35, such that roller bearing 36 extends longitudinally perpendicular from post member 35. Roller bearing 36 axially rotates, acting as cam follower. Roller bearing 36 travels along upper cam surface 31 during operation. Hinge post 39 extends longitudinally parallel with upright support post 12 at an offset distance from upright support post 12.

Figure 2:
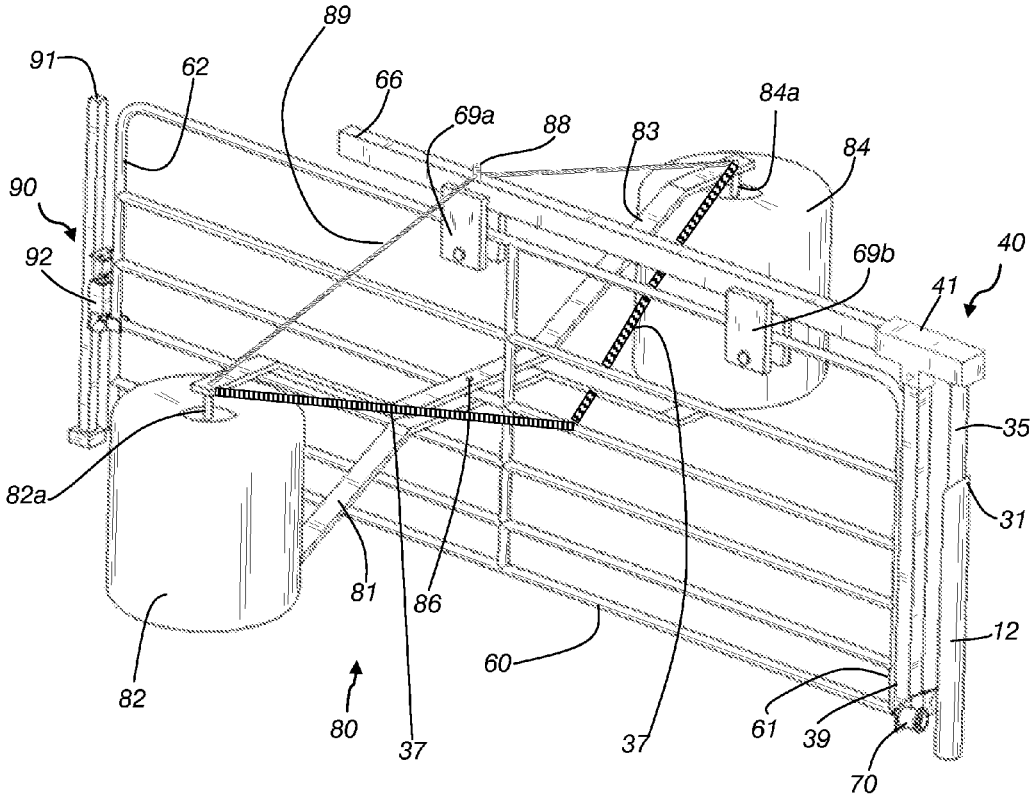
FIG. 2 is a perspective view of a self-closing entry system, showing configuration of the self-closing entry system without a latching means attached, according to the embodiment of FIG. 1.
Figure 3:
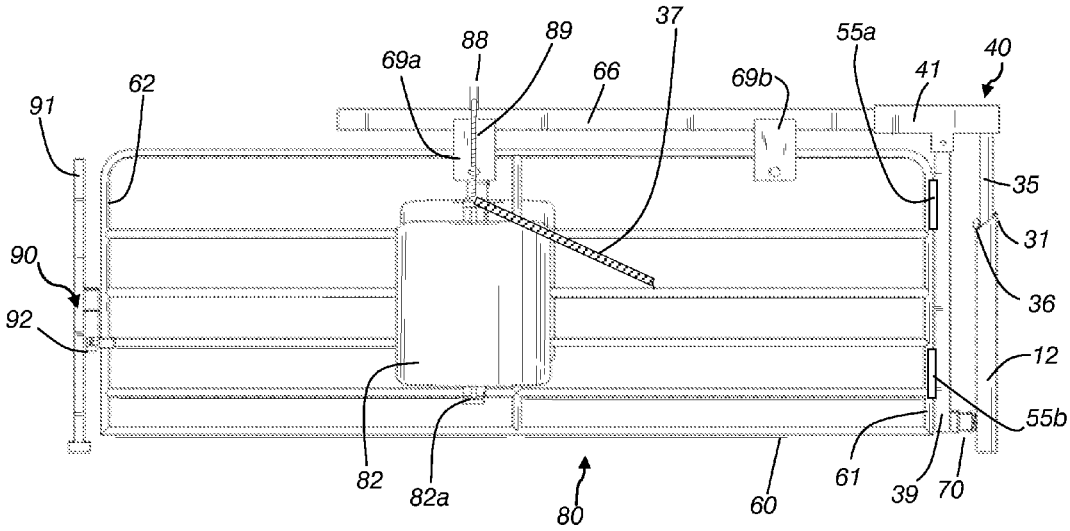
FIG. 3 is a front view of a self-closing entry system, showing the bumper assembly in a first rest position, according to the embodiment of FIG. 1.
Figure 4:
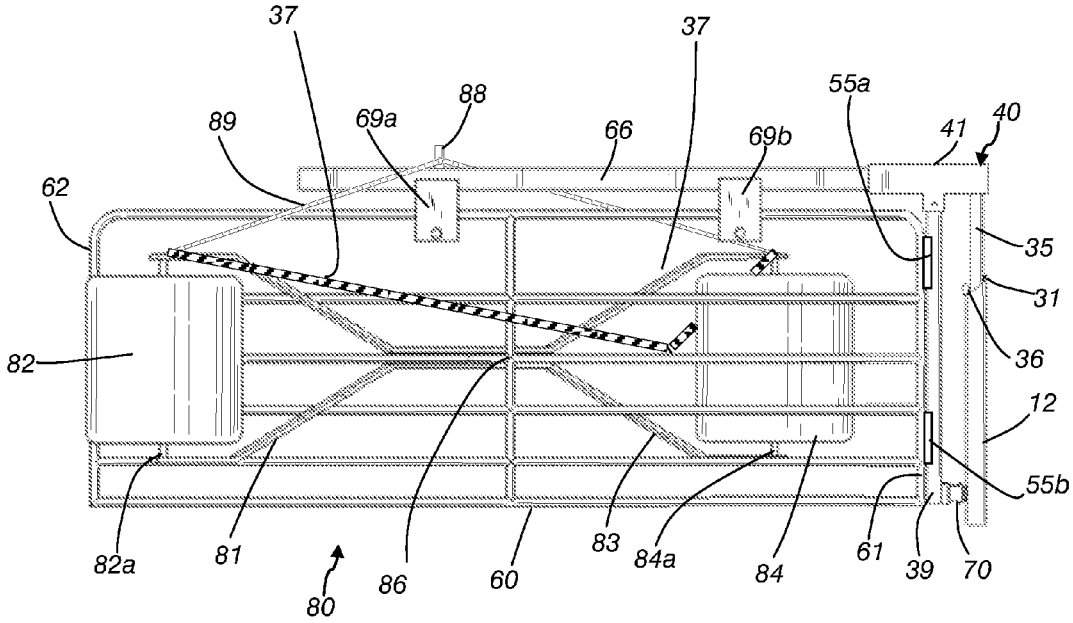
FIG. 4 is a front view of a self-closing entry system, showing the bumper assembly in a second rotatable position, according to the embodiment of FIG. 1.

Referring to FIGS. 2-4, an entrance member 60 (such as a gate, or cattle guard, for example) extends longitudinally perpendicular relative to hinge post 39. Entrance member 60 is a rigid, substantially planar member, further defined by an entrance support side 61, an entrance latch side 62, and entrance support arm 66. Entrance support side 61 is attached to hinge post 39 by a fastening means. Fastening means of the embodiment comprises a set of mechanical brackets and set screws 55*a*, 55*b*. Entrance support arm 66 is a longitudinally extending support member, fixedly attached to entrance member 60 by an attachment means. Attachment means of the preferred embodiment comprises j-bolts 69*a*, 69*b* securably fastening entrance member 60 to entry support arm 66. The entrance member 60 of the preferred embodiment illustrates a structure with a number of support beams. However, any type of suitable entry member may be substituted.

Referring to FIGS. 1-4, receiver coupler element 40 is a rigid connection post defining a longitudinally extending receiver body 41. The receiver element is a rigid "T" shaped connection. Receiver coupler element 40 receives the post member 35, hinge post 39, and entry support arm 66.

Figure 10:
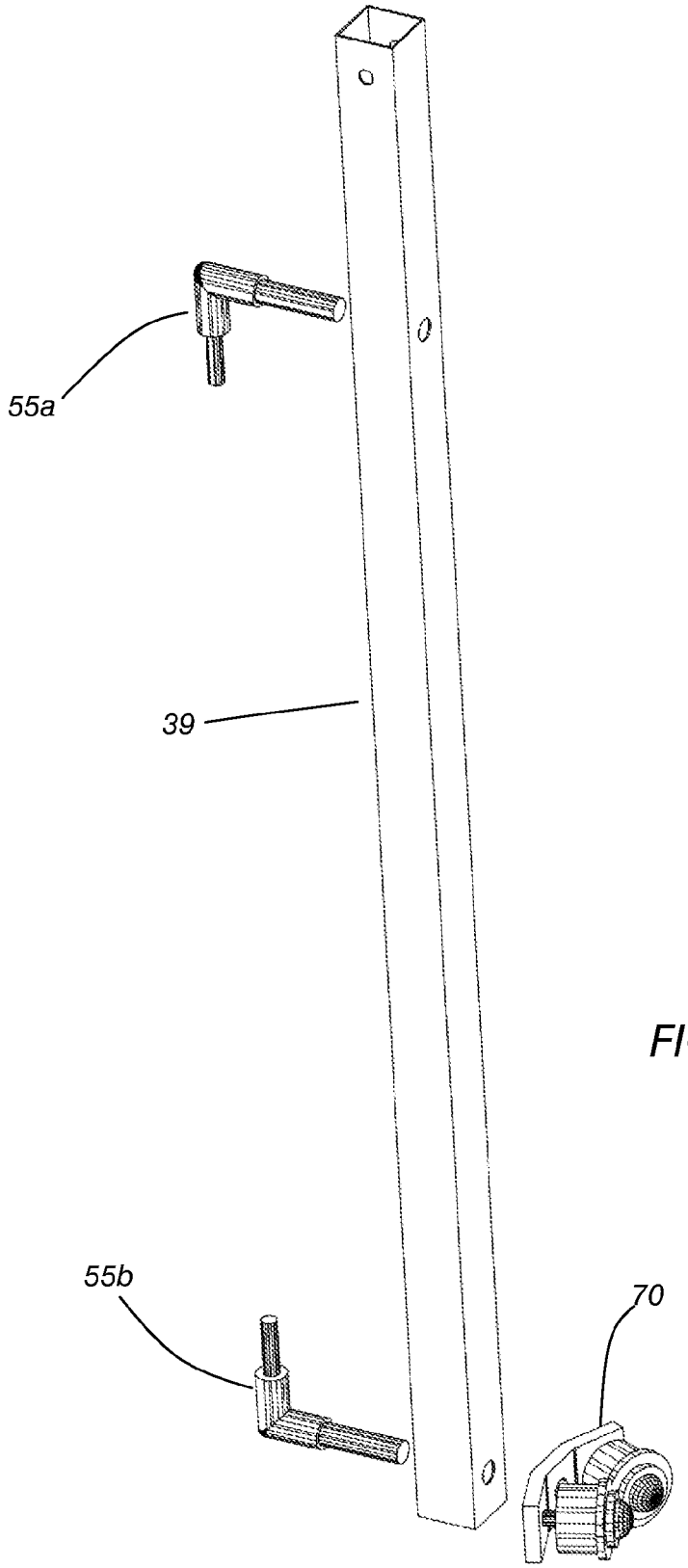
FIG. 10 is an exploded perspective view of a hinge post, a hinge bearing structure, and attachment means, according to the embodiment of FIG. 1.
Figure 11:
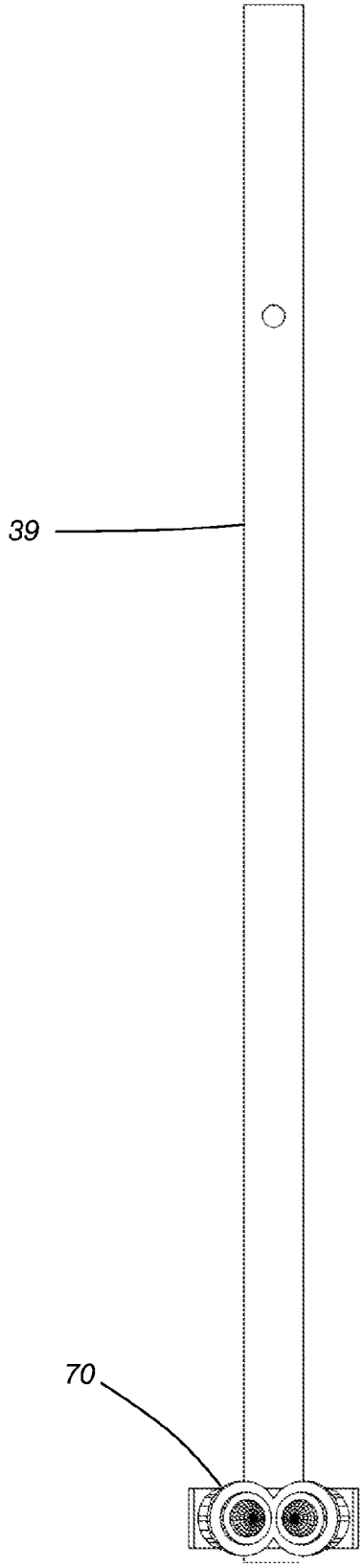
FIG. 11 is a side view of a hinge post and a hinge bearing structure, according to the embodiment of FIG. 1.
Figure 14:
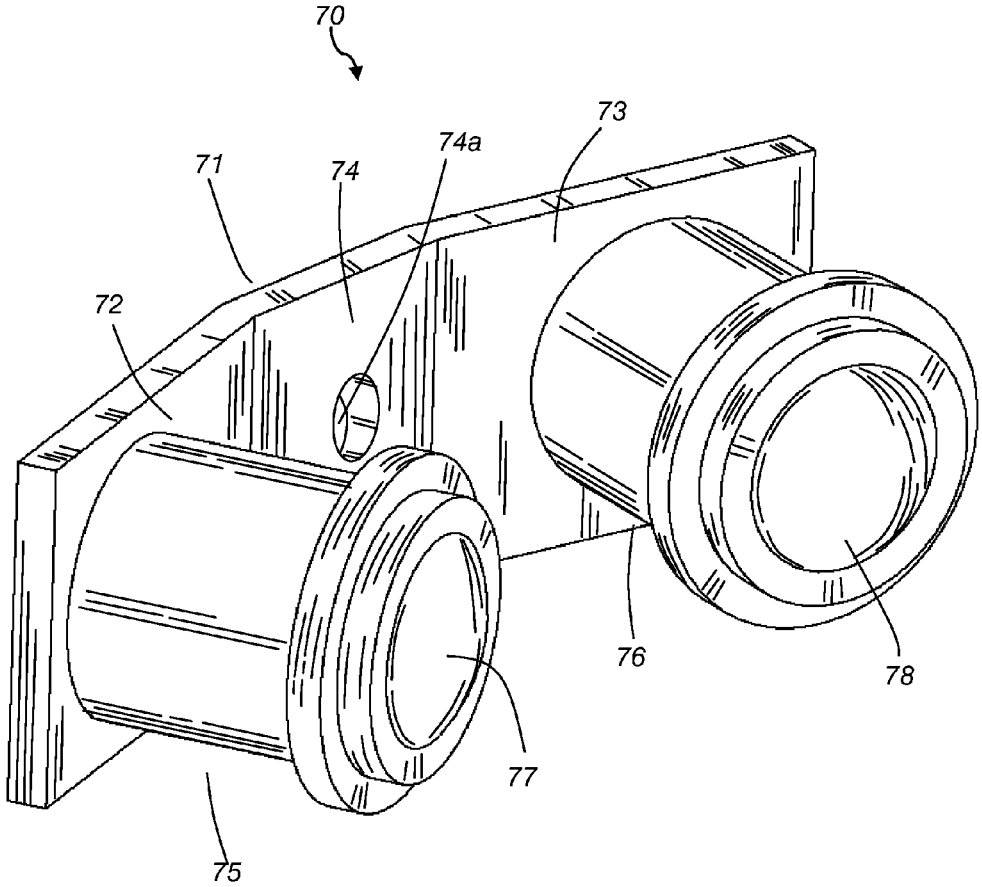
FIG. 14 is a perspective view of a hinge bearing structure according to the embodiment of FIG. 1.

Referring to FIGS. 1-4, hinge bearing structure 70 is located between hinge post 39 and upright support post 12. Hinge bearing structure 70 has a rigid support strut 71 fixedly attached to hinge post 39, and linear ball transfer bearings 75, 76 fixedly mounted onto rigid support strut 71. As shown in detail in FIGS. 10-11, 14, rigid support strut 71 has longitudinally extending frame bars 72, 73, forming a dihedral angle about a central surface 74. Central surface 74 has surface aperture 74*a* for attachment of hinge bearing structure 70 to hinge post 39. Linear transfer bearings 75, 76 are fixedly attached to each longitudinally extending frame bars 72, 73, such that ball contact surfaces 77, 78 rest against upright support post 12, as shown in FIG. 14. During opening/closing of entrance member 60, ball contact surfaces 77, 78 rotate around upright support post 12.

Figure 8:
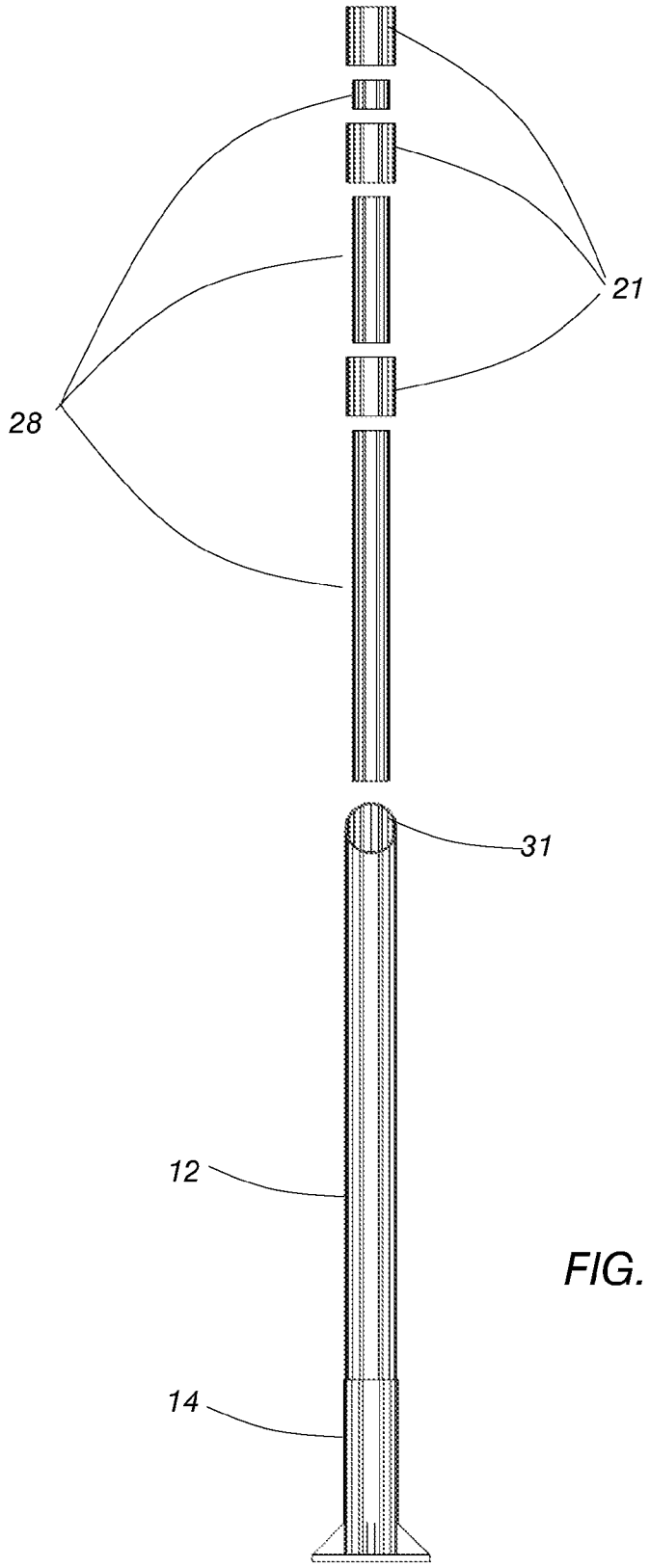
FIG. 8 is an exploded front view of an upright support post, a foundation member, an at least one bearing member, a post member, an at least one linear bearing, and spacers, according to the embodiment of FIG. 1.
Figure 9:
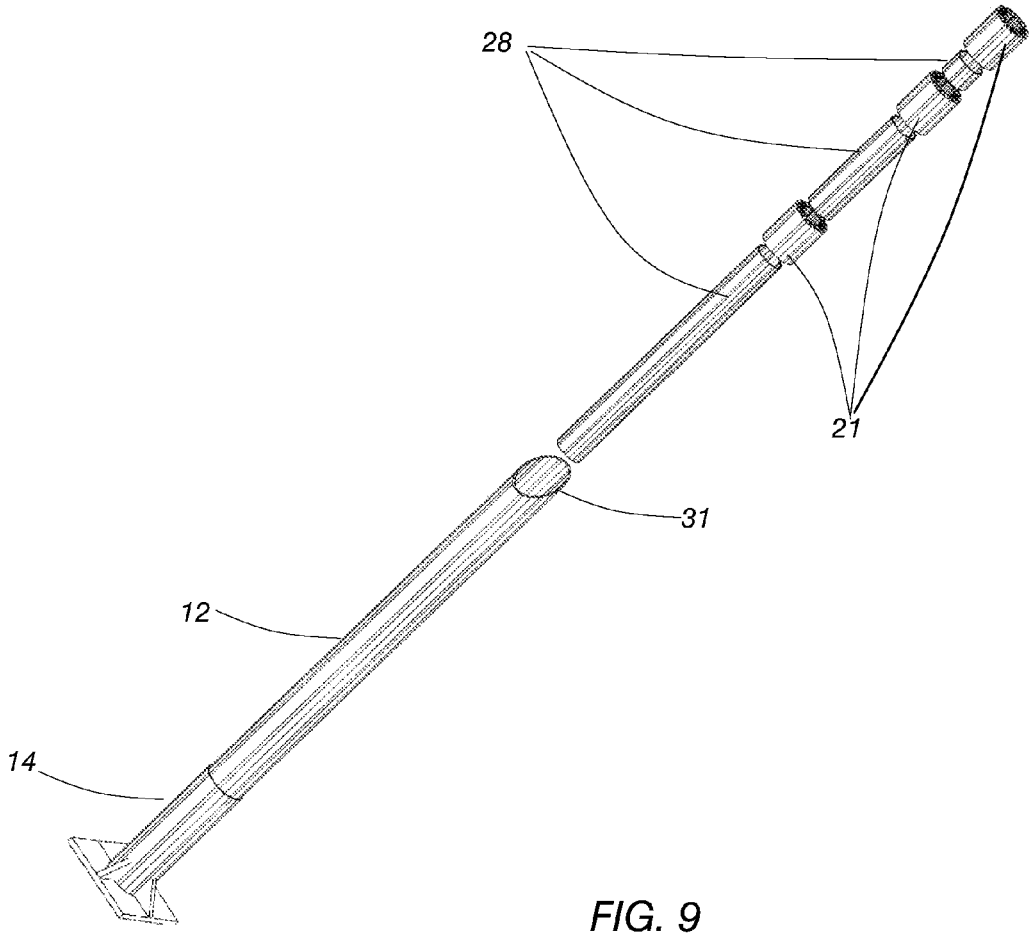
FIG. 9 is an exploded perspective view of an upright support post, a foundation member, an at least one bearing member, a post member, an at least one linear bearing, and spacers, according to the embodiment of FIG. 1.
Figure 12:
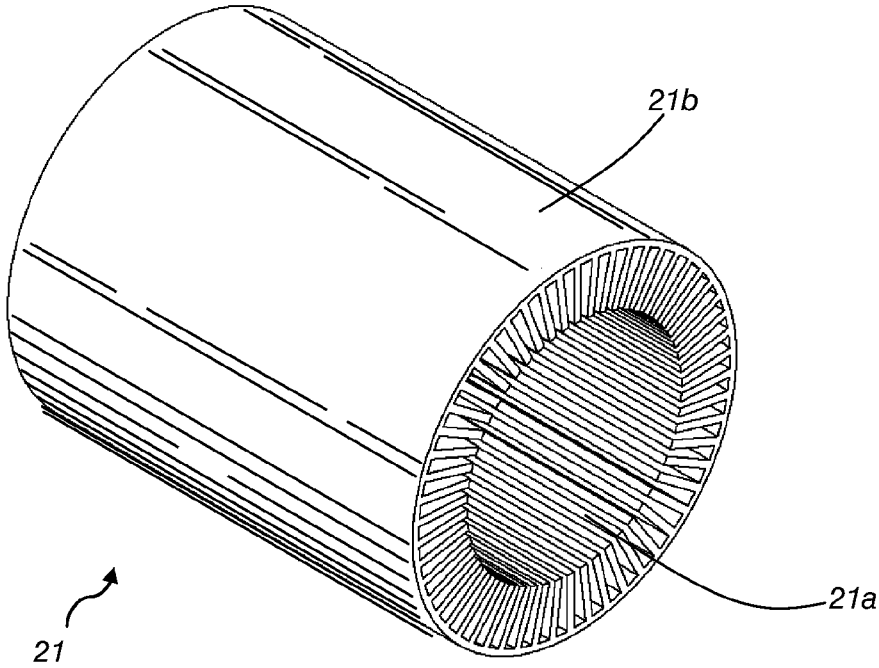
FIG. 12 is a perspective view of a linear bearing according to the embodiment of FIG. 1.
Figure 13:
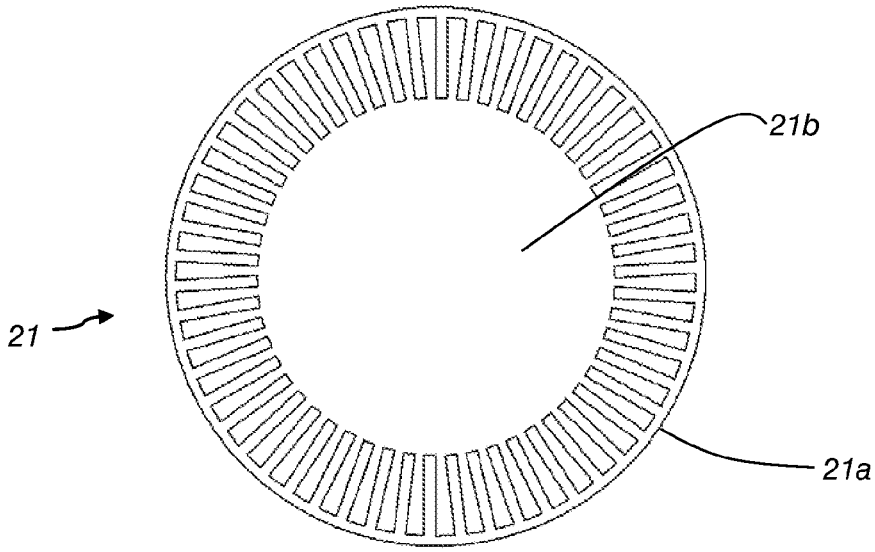
FIG. 13 is a top view of a linear bearing according to the embodiment of FIG. 1.
Figure 15:
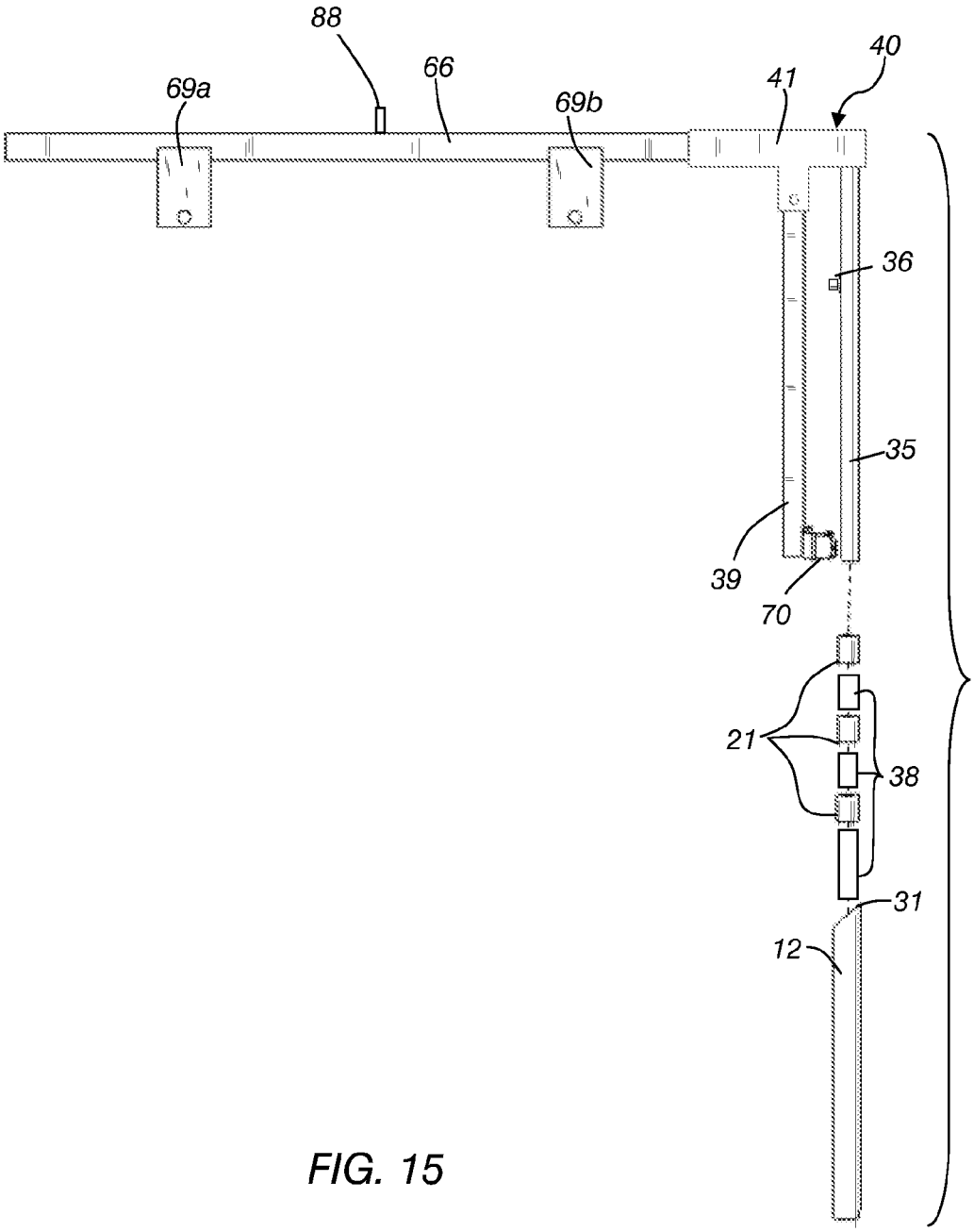
FIG. 15 is an exploded front view of a an upright support post, a foundation member, an at least one bearing member, a post member, an at least one linear bearing, spacers, a hinge post, a hinge bearing structure, and attachment means, according to the embodiment of FIG. 1.

Referring to FIG. 8 and FIG. 9, at least one linear bearing 21 is disposed within upright support post 12, distributing weight along support post 12 during opening/closing of entrance member 60. As shown in FIG. 8 and FIG. 9, the preferred embodiment has three linear bearings 21 (however, differing numbers or combinations and types of linear bearing structures are contemplated) concentrically disposed within upright support post 12. As shown in detail in FIG. 12 and FIG. 13, each linear bearing 21 has bearing cavities 21*b* and bearing outer surfaces 21*a*. Post member 35 depends through bearing cavities 21*b*, and bearing outer surfaces 21*a* make contact with upright support post 12. According to the embodiment, linear bearings 21 are set along the distance of support post 12, and set apart from each other by one or more spacers 38. Spacers 38 are resilient cylindrical members, concentrically disposed within upright support post 12. Post member 35 depends through spacers 38, as shown in FIG. 15. The preferred embodiment shows the use of linear bearings, however differing types of bearings may be used. For example, a plain bearing, a rolling element bearing, a jewel bearing, or a fluid bearing may also be used.

Figure 16:
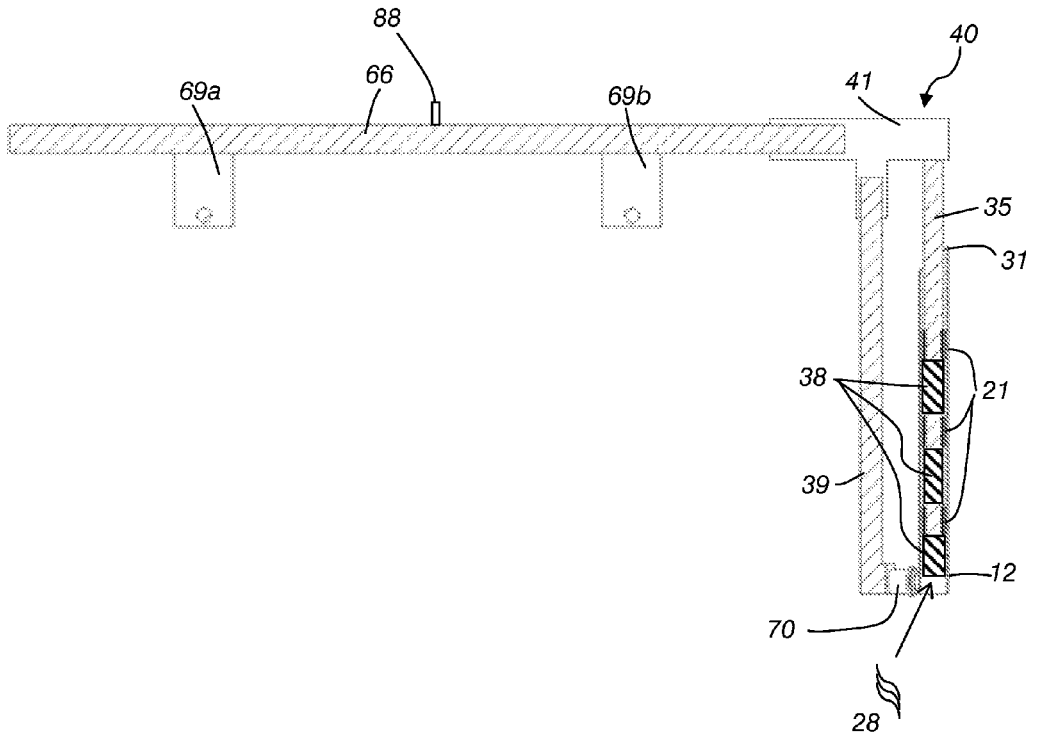
FIG. 16 is a partial cross-sectional front view of a an upright support post, a foundation member, an at least one bearing member, a post member, an at least one linear bearing, spacers, a hinge post, a hinge bearing structure, and attachment means, according to the embodiment of FIG. 1.

Referring to FIG. 16, upright support post 12 is filled with a fluid 28. The fluid 28 of the preferred embodiment is a viscous lubricant serving to further distribute point load pressures. The fluid 28 also acts to reduce friction between upright support post 12 and bearing outer surfaces 21*a*. In the preferred embodiment, fluid 28 is a colligative agent such as ethylene glycol. However, other suitable fluids may be used.

Referring to FIGS. 1-7, a bumper assembly 80 actuates opening/closing of the entrance member 60. Bumper assembly 80 has a first bumper frame member 81 pivotably attached to a fulcrum 86, a first bumper contact element 82 capable of independent axial rotation in relation to first bumper frame member 81, a second bumper frame member 83 attached to fulcrum 86, and a second bumper contact element 84 capable of independent axial rotation in relation to second bumper frame member 83. First bumper contact element 82 and second bumper contact element 84 are cylindrical rollers, capable of axial rotation about axes members 82*a*, 84*a*.

Figure 5:
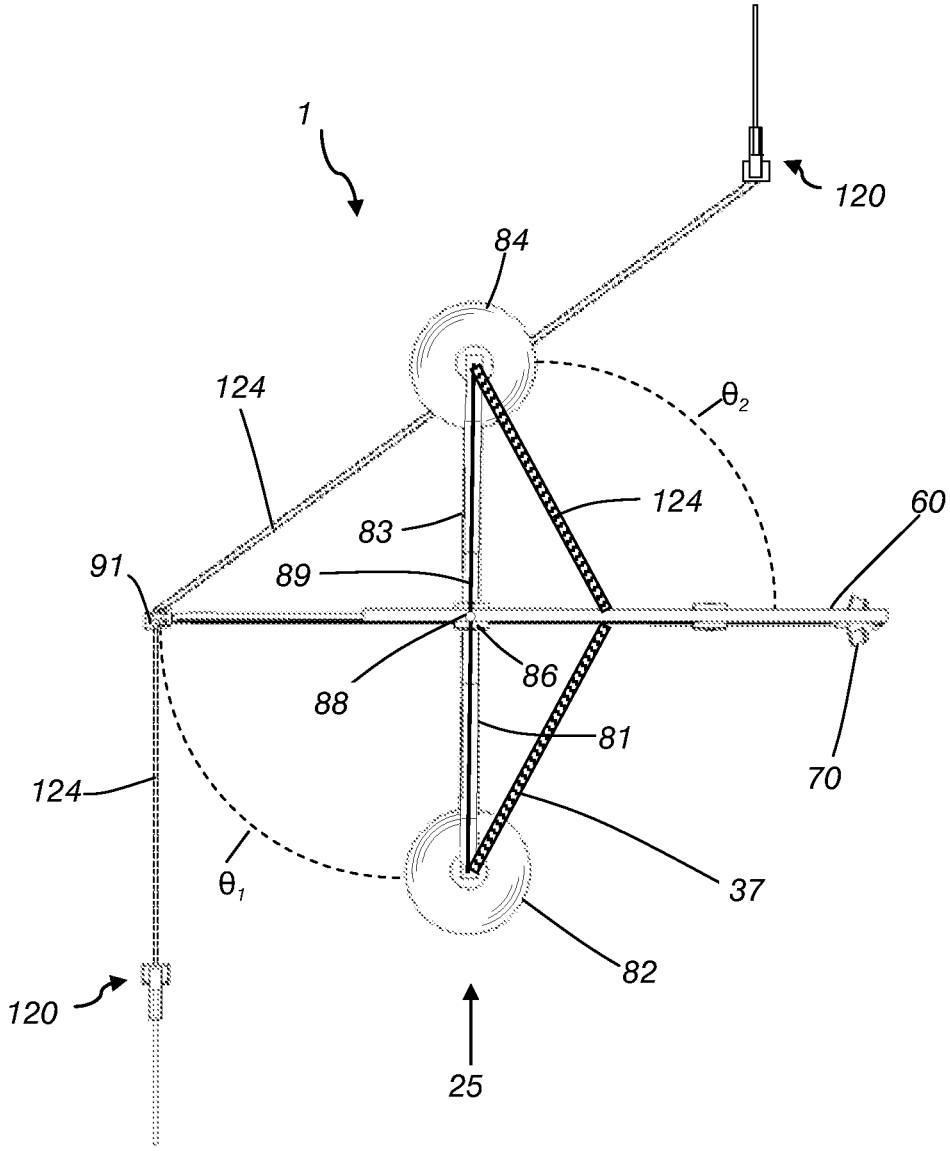
FIG. 5 and FIG. 5A are top plan views of a self-closing entry system, showing the bumper assembly in a first reset position, and illustrating rotation of a bumper assembly relative to an applied force, according to the embodiment of FIG. 1.
Figure 5A:
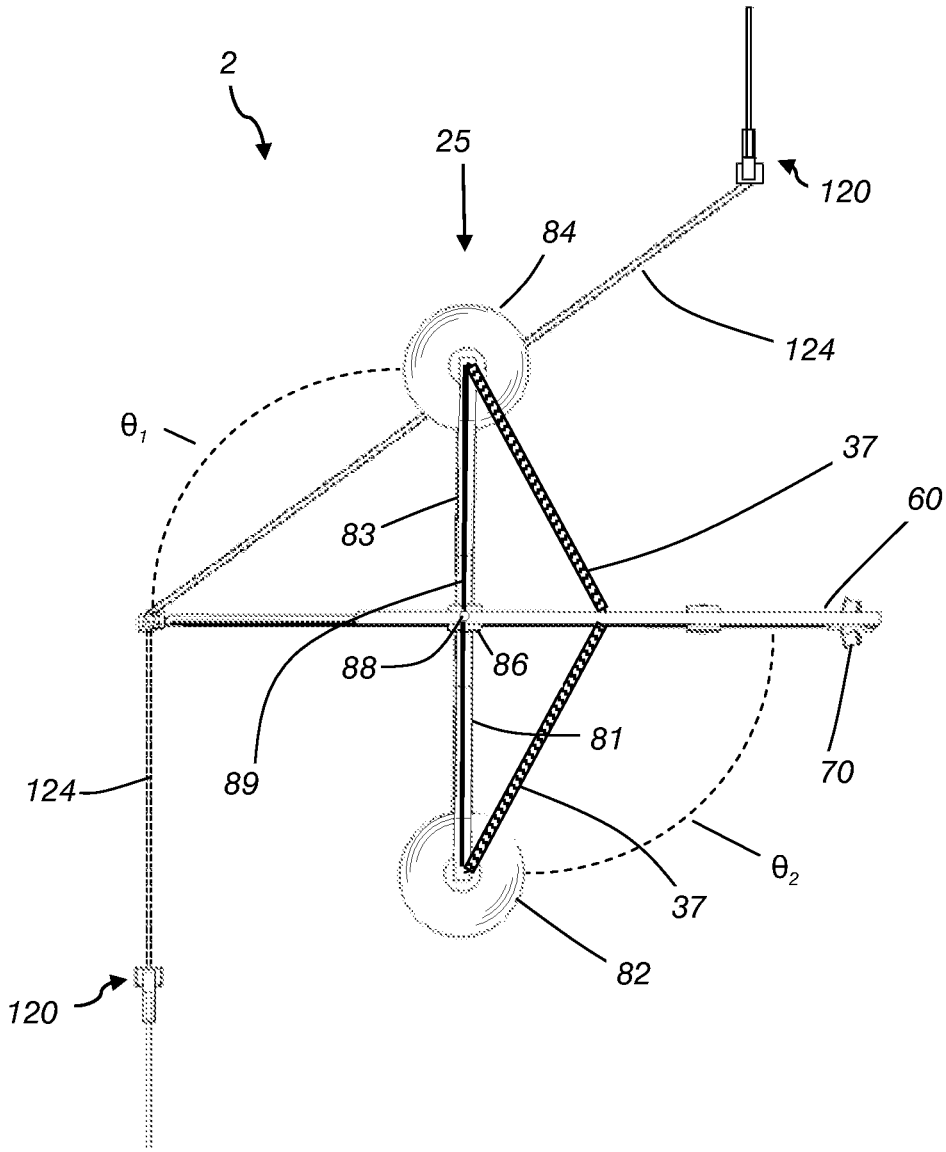
Figure 6:
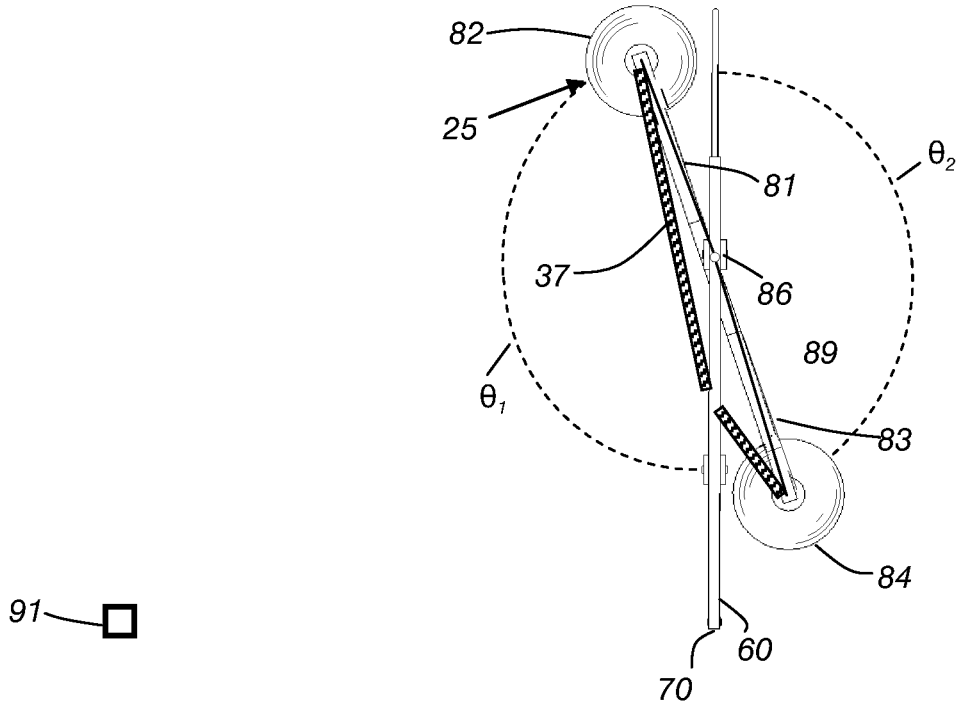
FIG. 6 and FIG. 6A are top plan views of a self-closing entry system, showing the bumper assembly in a second rotatable position, and illustration rotation of a bumper assembly relative to an applied force, according to the embodiment of FIG. 1.
Figure 6A:
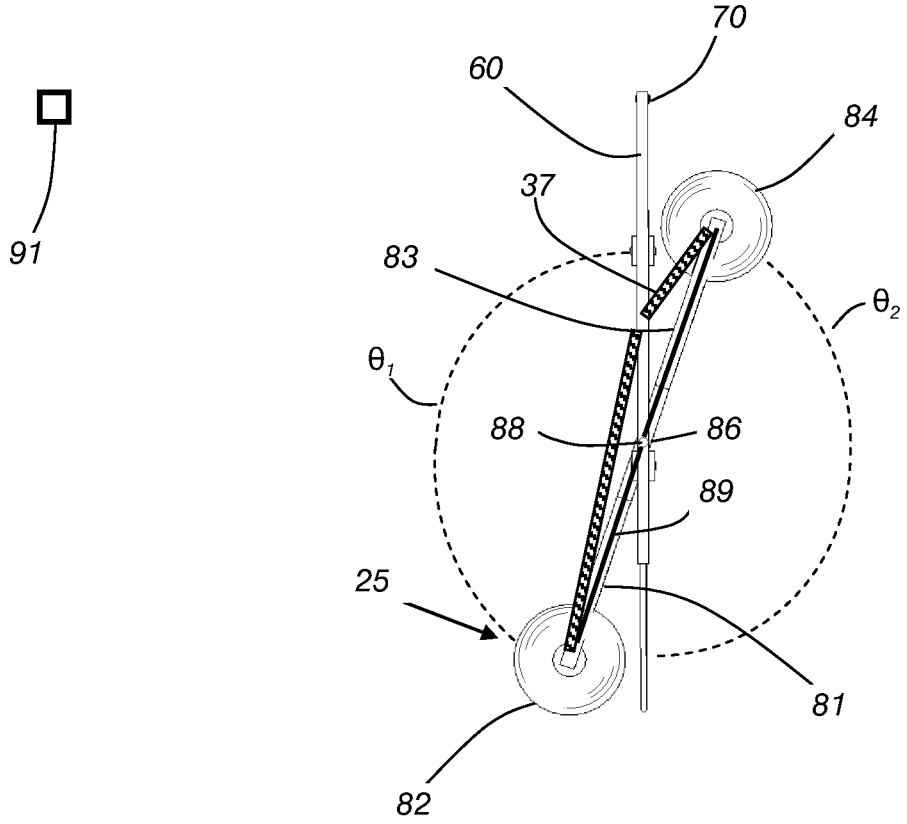
Figure 7:
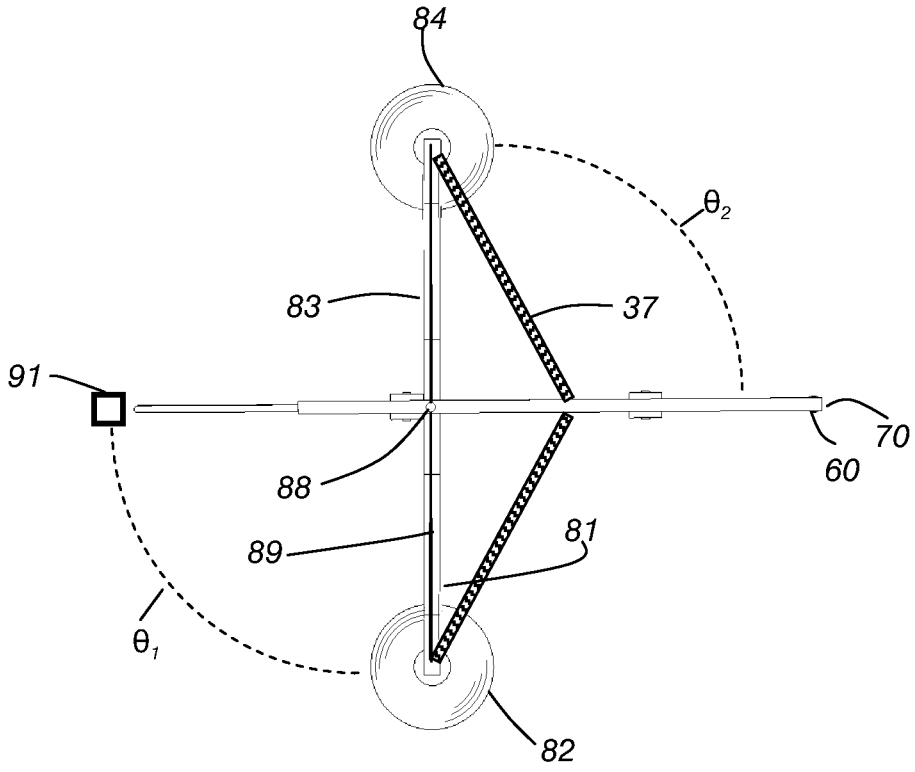
FIG. 7 is a top plan view of a self-closing entry system, showing the bumper assembly in a first reset position, according to the embodiment of FIG. 1.

Relative motion of bumper assembly 80 with respect to entrance member 60 is illustrated in FIGS. 5-7. Application of a continuous force 25 (such as a force induced by a vehicle) against first bumper contact element 82, causes first bumper contact element 82 to axially rotate with respect to axis member 82*a*. Further application of a force 25 causes first bumper frame member 81 to pivotably rotate about gate fulcrum 86 from a first reset position 1 (as shown in FIG. 5) to a second rotatable position 2 (as shown in FIG. 6) thereby moving entrance member 60 to an open position. As shown, application of the force 25 is approximately tangent to the outer surface of first bumper contact element 82 during such movement. Such a force can be applied by a longitudinally extending surface passing through the entrance, such as that applied by the side of a vehicle. Removal of force 25 against first bumper contact element 82 causes first bumper frame member 81 to pivotably rotate from second rotatable position 2 to said first reset position 1, thereby moving entrance member 60 back to a closed position (as shown in FIG. 7). As shown in FIG. 5A and FIG. 6A, application of a force 25 against second bumper contact element 84 causes opposing movement of entrance member 60.

First bumper frame member 81 and said second bumper frame member 83 exist as a contiguous assembly, forming a simple lever capable pivoting about fulcrum 86. Counter-balance assembly 89, extends from first bumper contact element 82 to second bumper contact element 84, through pivot member 88. Counter-balance assembly 89 is an elongate tensile structure. In the preferred embodiment, counter-balance assembly 89 is a metal chain. However, counter-balance assembly 89 may be other types of suitable tensile structures, such as elastic cable, for example. Tension of counter-balance assembly 89 causes opposing axial rotation between first bumper frame member 81 and second bumper frame member 83. As illustrated in FIGS. 5-7, counter-balance assembly 89 causes first bumper frame member 81 to maintain a first central angle $\theta_1$ relative to entrance member 60 which approximately equivalent to a second central angle $\theta_2$ between second bumper frame member 83 and gate 60 during opening/closing of entrance member 60.

Referring to FIGS. 1-7, a reset mechanism 37 extends between the entrance member 60 and bumper assembly 80, causing the bumper assembly to reset when said force 25 is removed from either the first bumper contact element 82 or second bumper contact element 84. In the preferred embodiment, reset mechanism 37 is a pair of longitudinally extending springs.

Figure 20:
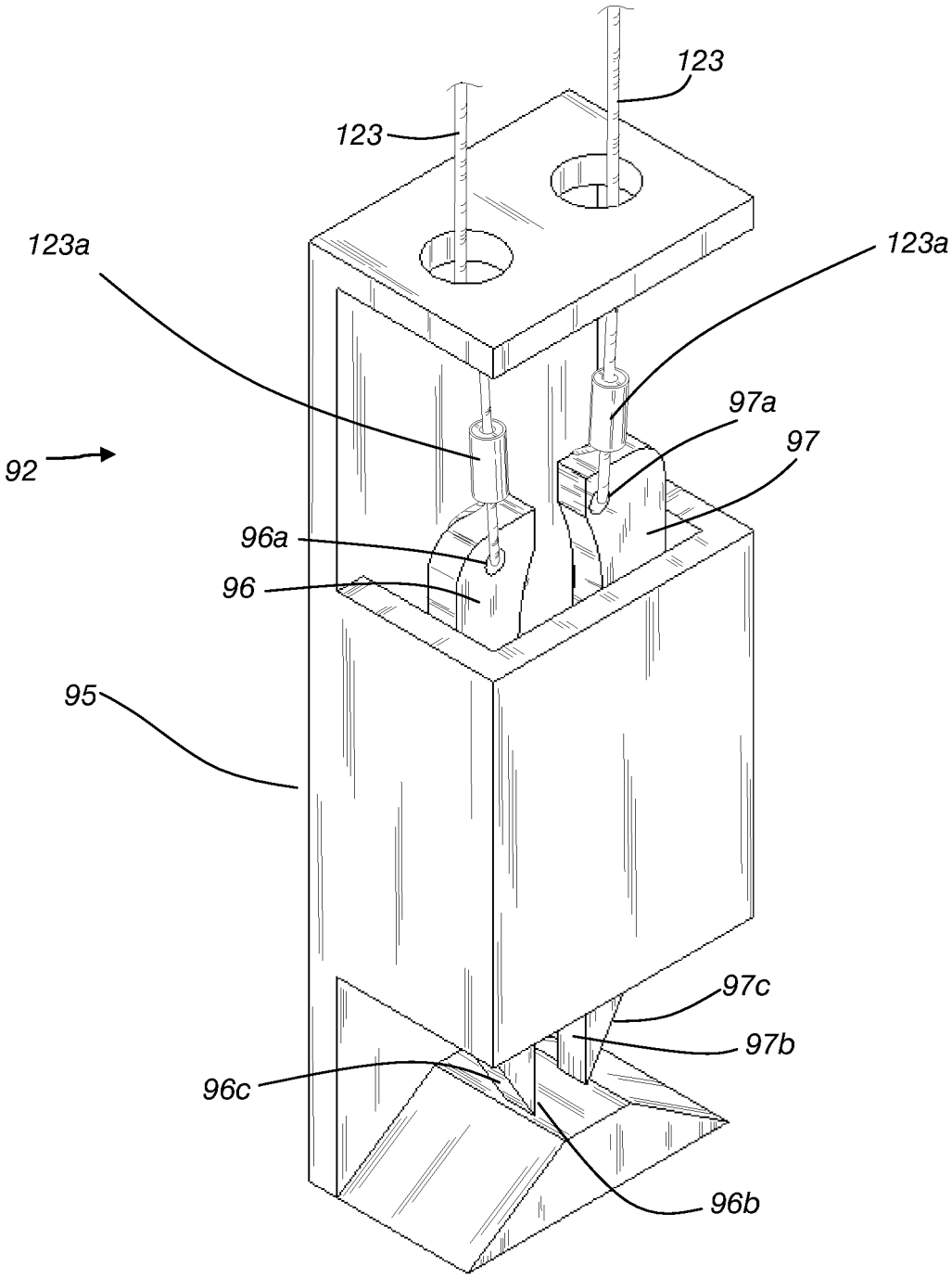
FIG. 20 is a perspective view of a means for latching according to the embodiment of FIG. 1.
Figure 21:
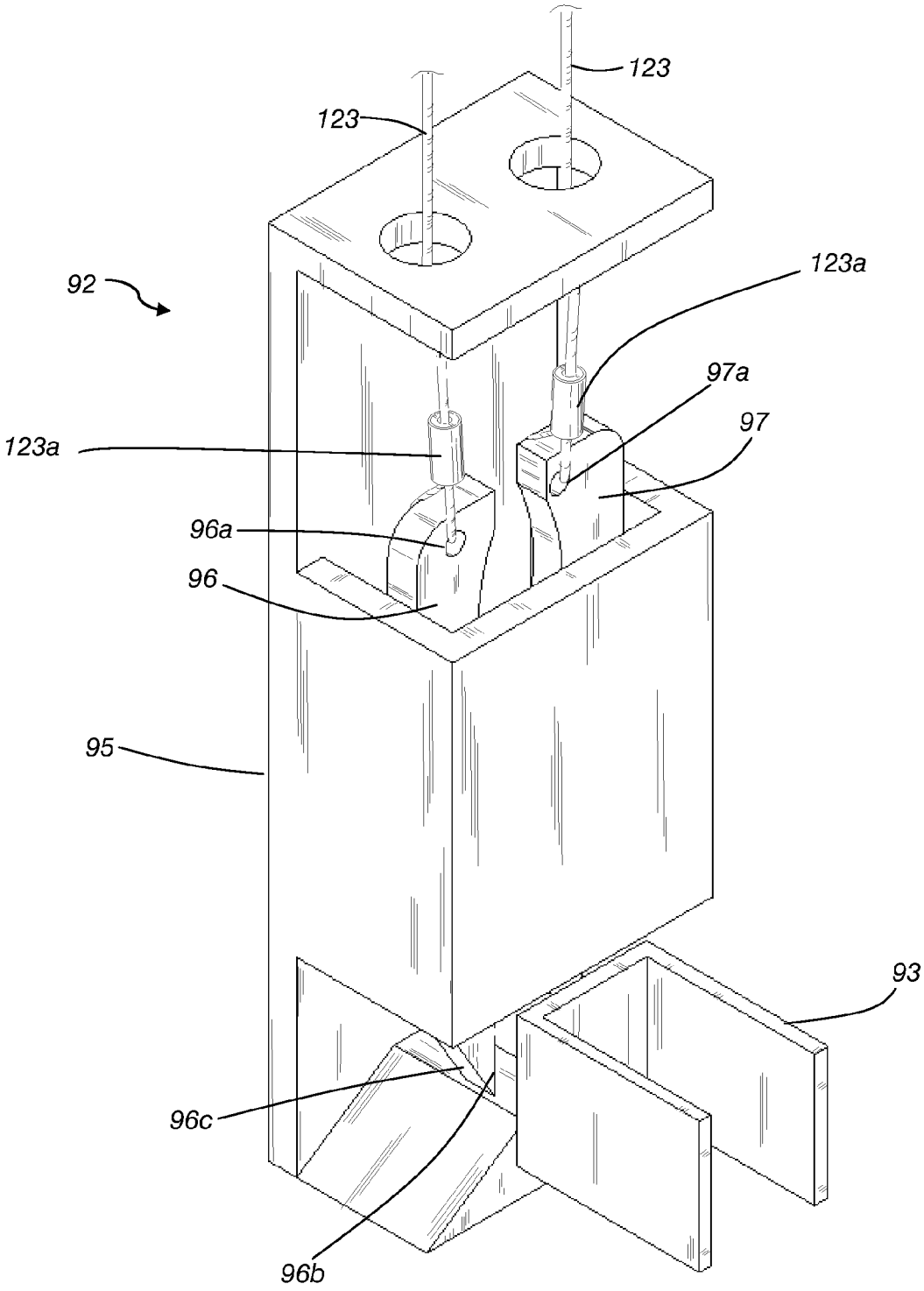
FIG. 21 is a perspective view of a means for latching, showing the latch pin housing, according to the embodiment of FIG. 1.
Figure 22:
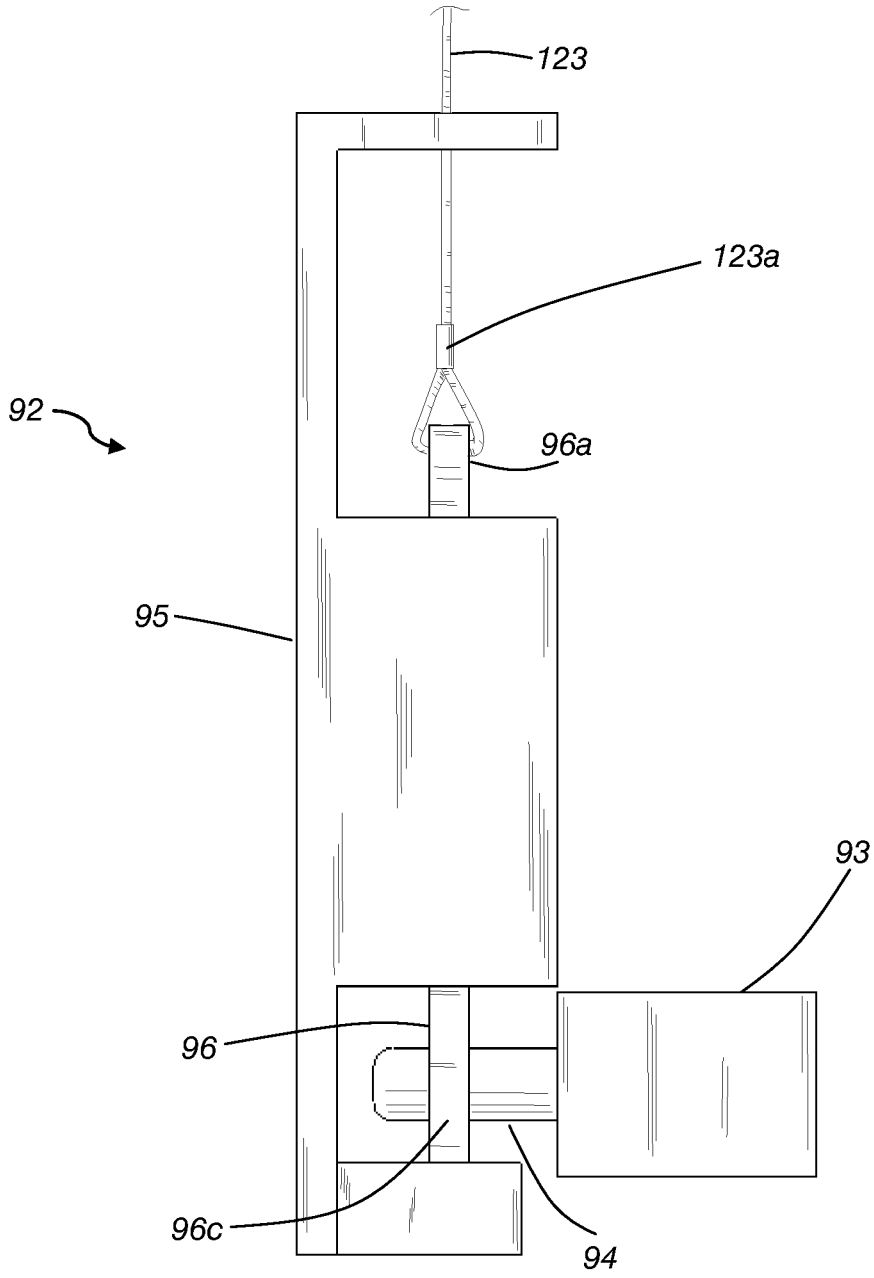
FIG. 22 is a side view of a means for latching according to the embodiment of FIG. 1.

Referring to FIGS. 20-22, a means for latching 90 has a latching post 91, a mechanical latch 92, latch pin housing 93, and latch pin 94. Latching post 91 is fixedly attached to the ground extends longitudinally parallel relative to upright support post 12, located proximate to entrance latch side 62. Latch pin housing 93 is connected to entrance side 62. Latch pin 94 extends from latch pin housing 93 into mechanical latch 92. Mechanical latch 92 is fixed to latching post 91, and has a housing member 95, a first latch plate 96, and a second latch plate 97. First latch plate 96 and second latch plate 97 have stopping surfaces 96*b*, 97*b*, and apertures 96*a*, 97*a*, and angled surfaces 96*c*, 97*c*.

Latching control means 100 is a mechanism for opening/closing entrance member 60. According to the preferred embodiment, control structures 120 are located at opposing sides of entrance member 60, as illustrated in FIG. 5. Engagement of either control structure 120 allows opening of entrance member 60.

Figure 17:
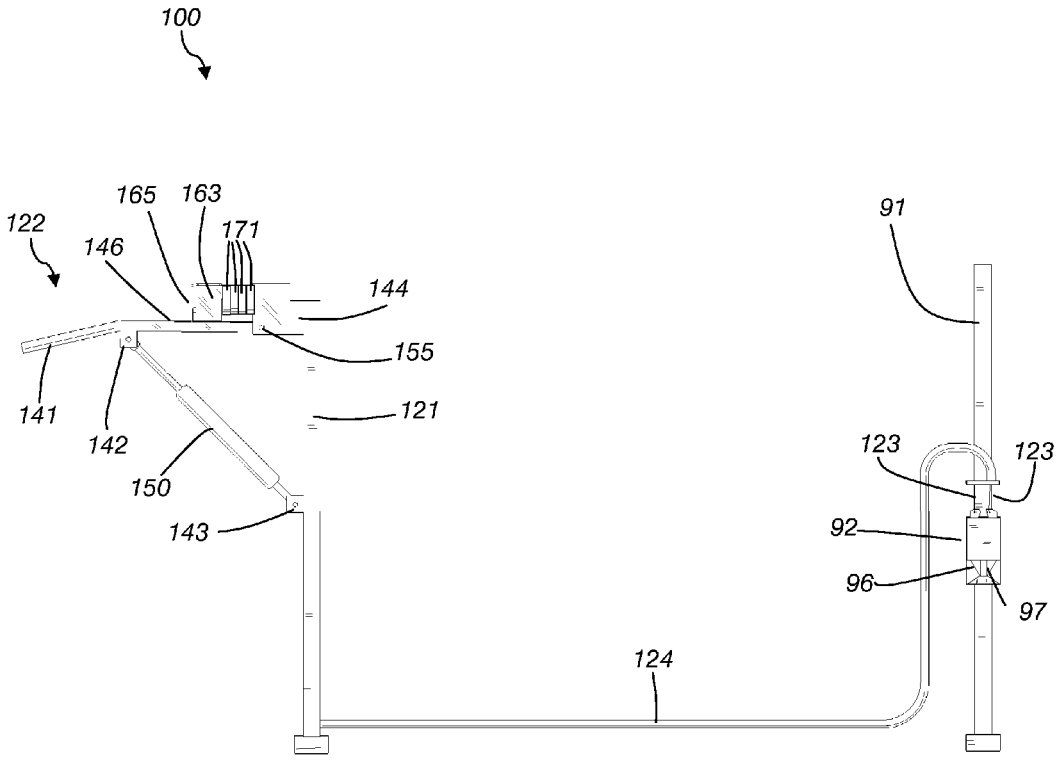
FIG. 17 is a side view of a control means and a means for latching according to the embodiment of FIG. 1.
Figure 18:
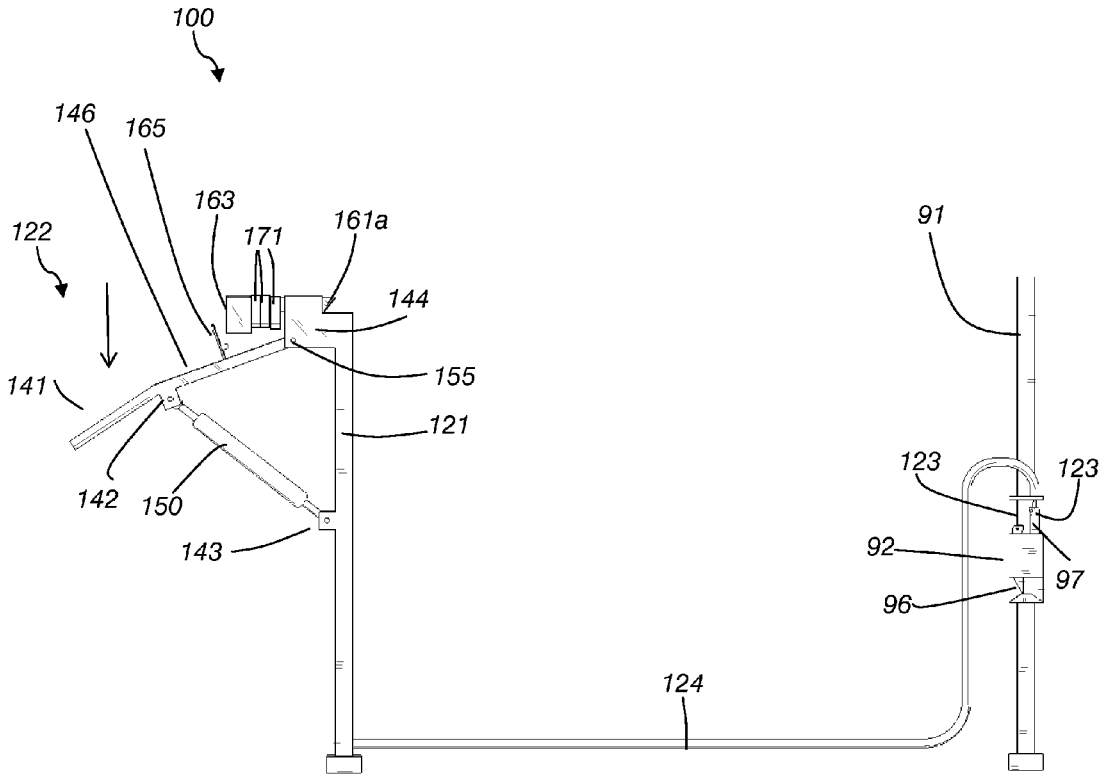
FIG. 18 is a side view of a control means and a means for latching, showing activation, according to the embodiment of FIG. 1.
Figure 19:
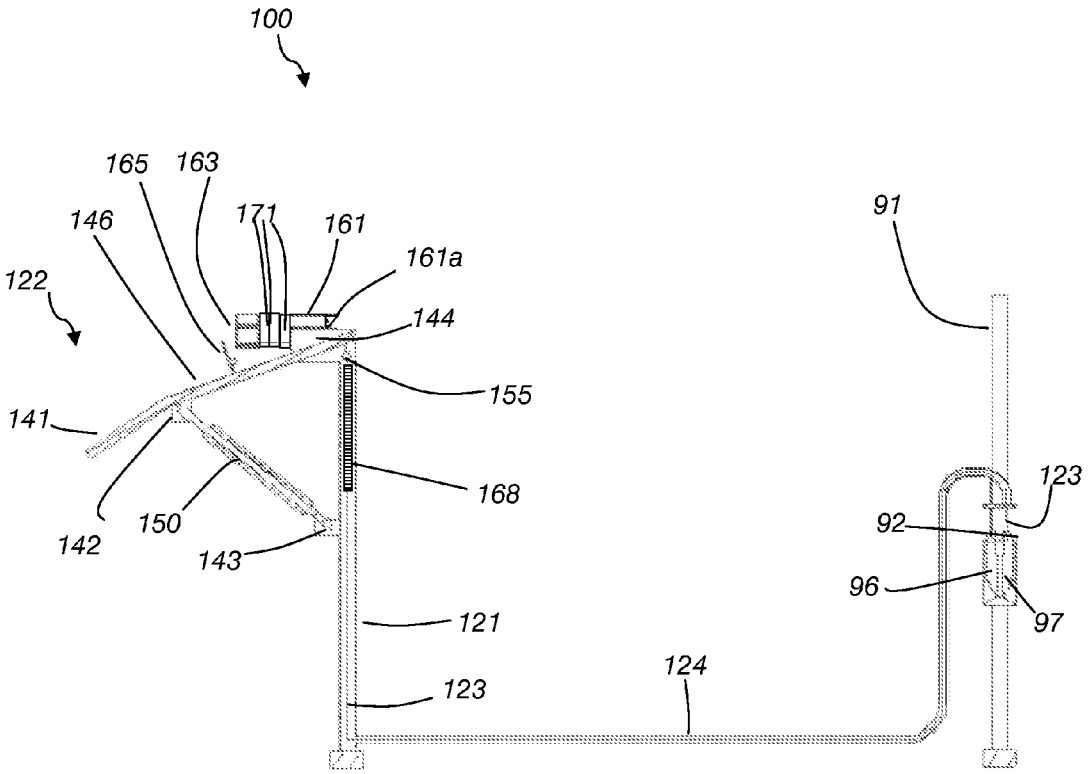
FIG. 19 is a partial cross-sectional side view of a control means and a means for latching, showing activation, according to the embodiment of FIG. 1.

Referring to FIGS. 17-19, control structure 120 has a lifting means 122, lifting cable 123, and lifting cable housing 124. Engagement of control structure 120 causes lifting cable 123 to retract towards control structure 120, thereby providing lift to means for latching 90. Lifting cable 123 is connected to first latch plate 96 and second latch plate 97, through aperture 96*a*, 97*a* and secured by crimp clips 123*a*. Lifting cable housing 124 is a protective sheathing, which can be located above or below the surface of the ground. The path of the lifting cable housing 124 between control structure 120 to means for latching 90 can vary. Each control structure 120 engages either first latch plate 96 or second latch plate 97 which is located at the opposing side of entrance member 60, as shown in FIGS. 17-19. Control structure 120 engages first latch plate 96 or second latch plate 97 to allow one-way movement of entrance member 60.

Referring to FIG. 17, control structure 120 has a lifting cable 123 attached to second latch plate 97 at aperture 97*a*. Before engagement of control structure 120, latch pin 94 rests between first latch plate 96 and second latch plate 97.

Referring to FIG. 18, engagement of control means 120 causes lifting cable 123 to raise second latch plate 97 from housing member 95. Latch pin 94 is then capable of moving in one direction (opposing movement is restricted by stopping surface 96*b*) respective of mechanical latch 92, and entrance member 60 is then allowed to move from first reset position 1 to second rotatable position 2.

Second latch plate 97 is then lowered back into housing member 95. As entrance member 60 moves back from second rotatable position 2 to first reset position 1, latch pin 94 slidably lifts second latch plate 97 by sliding along angled surface 97*c*. Latch pin 94 slides between first latch plate 96 and second latch plate 97, and further movement is stopped by stopping surface 96*a*.

Lifting means 122, provides lift to lifting cable 123 upon engagement of control structure 120. According to the preferred embodiment, lifting means 122 further comprises a lift handle 141, upper lift pivot 142, hydraulic strut 150, lower lift pivot 143, rotation pin 155, lift housing member 144, slide rail housing 161, slide rail 161*a*, a plurality of spacing sliders 171, roller housing 163, set plate 165, lift body frame 146, roller 170, lock pin 177, recess cavity 173, roller pin 174, set pin 172, and spring mechanism 168, as shown in FIGS. 23-35.

Figure 23:
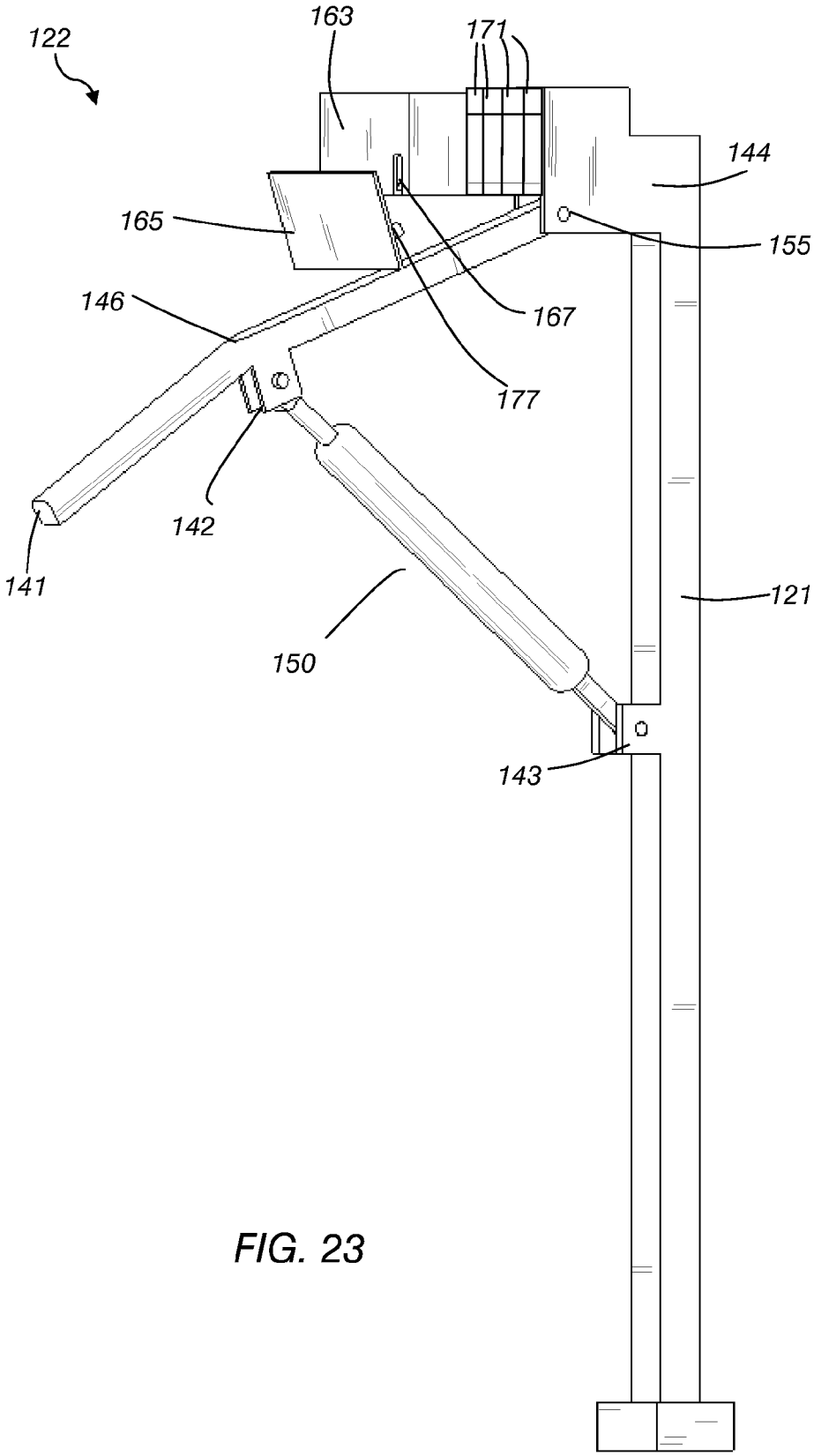
FIG. 23 is a perspective view of a lifting means, showing activation, according to the embodiment of FIG. 1.

Referring to FIG. 23, lift handle 141 and lift body frame 146 extend longitudinally perpendicular from control post 121, and rotate about rotation pin 155. Hydraulic strut 150 extends between upper lift pivot 142 and lower lift pivot 143. Slide rail 161*a* extends from roller housing 163 through slide rail housing 161. Slide rail housing 161 is attached to lift housing member 144. Four spacing sliders 171 (although differing numbers of spacing sliders are contemplated) are positioned between roller housing 163 and lift housing member 144, straddling slide rail 161*a*. Set plate 165 is fixedly attached to lift body frame 146. Lock pin 177 extends longitudinally perpendicular from set plate 165, aligned for engagement into recess cavity 173. Spring mechanism 168 is attached to lift body frame 146 at one end of spring mechanism 168. Lifting cable 121 is attached to opposing end of spring mechanism 168.

Figure 24:
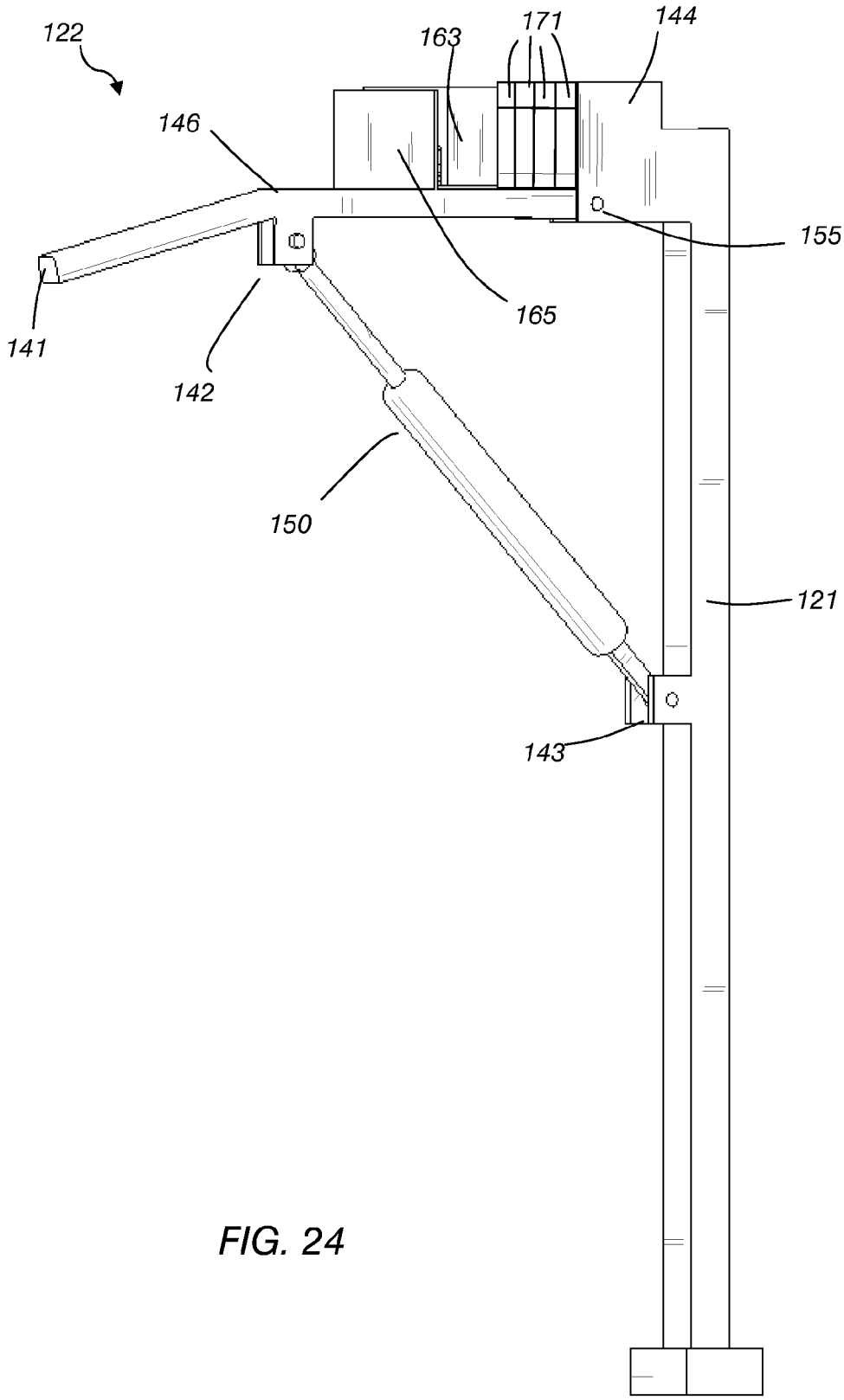
FIG. 24 is a perspective view of a lifting means according to the embodiment of FIG. 1.

Referring to FIG. 24, upon closing, set plate 165 rests against roller housing 163, and lock pin 177 extends through recess cavity 173. FIGS. 25A-25F illustrate movement of lifting means 122 before and during activation of control structure 120.

Figure 25A:
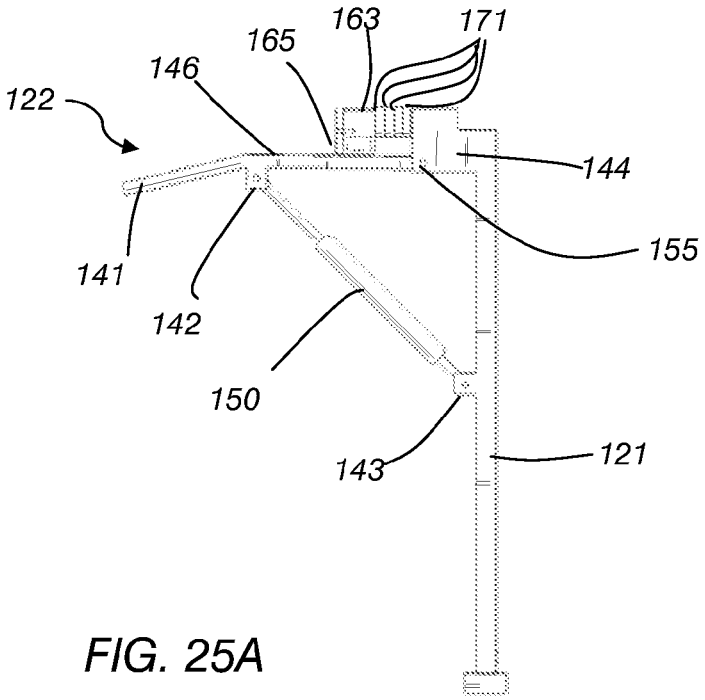
FIG. 25A is a partial cross-sectional side view of a lifting means, according to the embodiment of FIG. 1.

FIG. 25A illustrates lifting means 122 before activation. Lift handle 141 and lift body frame 146 rests in upward position, with set plate 165 resting against roller housing 163. Lock pin 177 rests upon roller 170. Four sliding spacers 171 exist along slide rail 161.

Figure 25B:
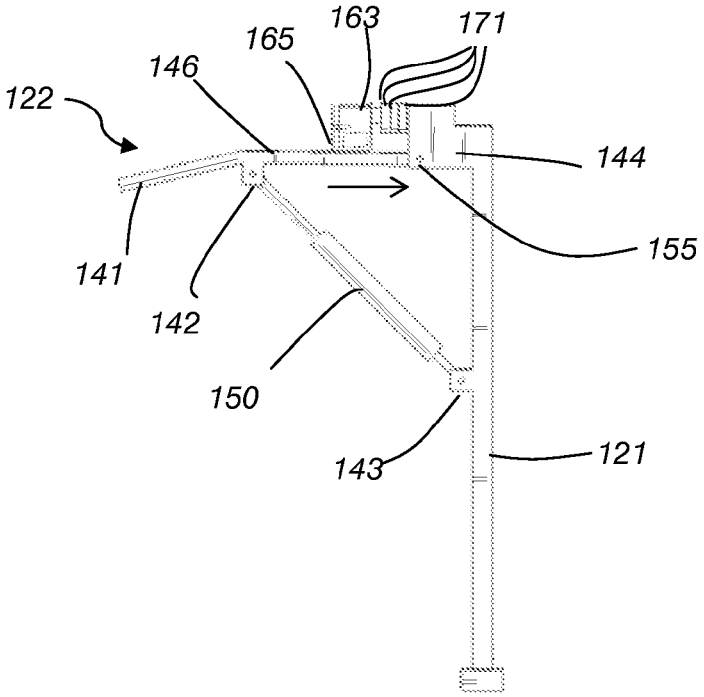
FIG. 25B is a partial cross-sectional side view of a lifting means, showing removal of a sliding spacer, according to the embodiment of FIG. 1.

Referring to FIG. 25B, one sliding spacer 171 is then removed, and roller housing 163 and slide rail 161*a* is pushed forward, towards lift housing member 144. Set plate 165 and lock pin 177 are thereby offset a distance from roller housing 163.

Figure 25C:
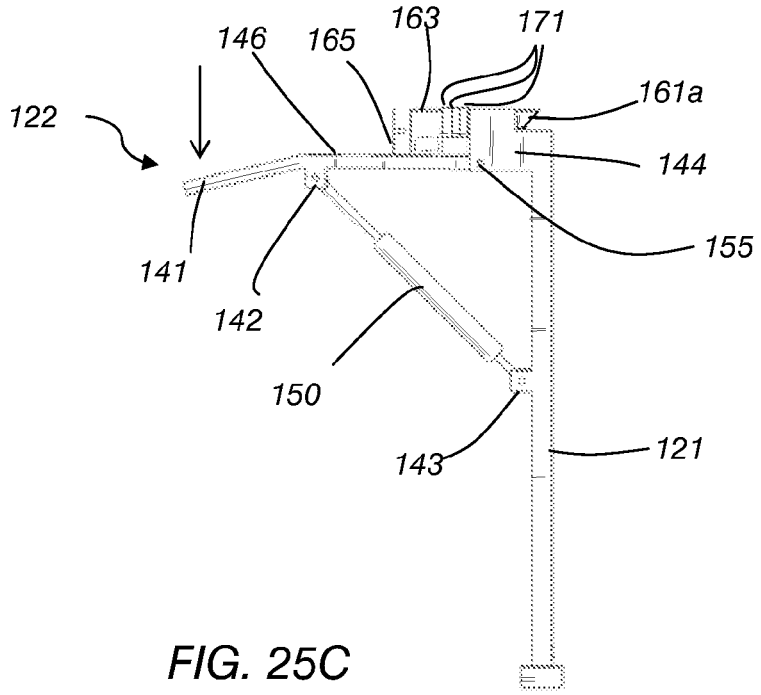
FIG. 25C is a partial cross-sectional side view of a lifting means, showing movement of a roller housing after removal of a sliding spacer, according to the embodiment of FIG. 1.
Figure 25D:
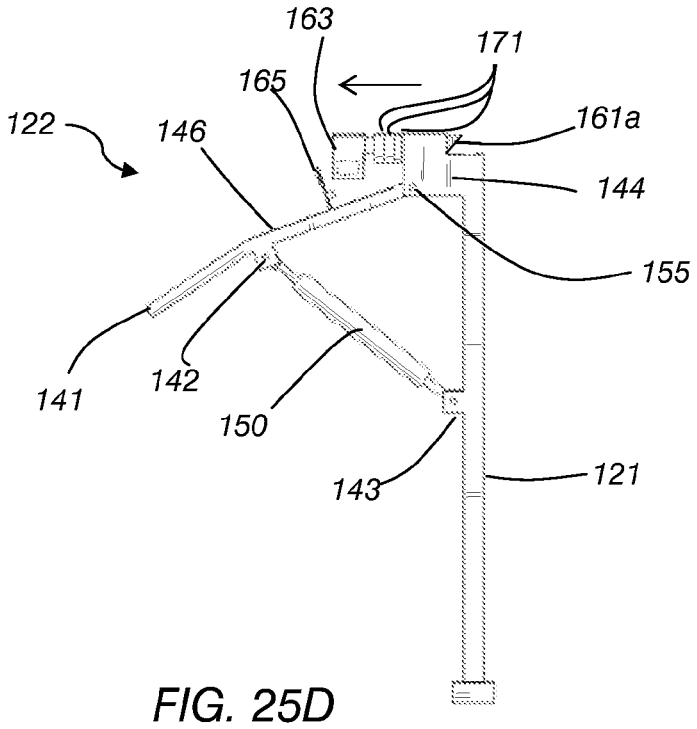
FIG. 25D is a partial cross-sectional side view of a lifting means, showing movement of a lift handle, according to the embodiment of FIG. 1.

Referring to FIG. 25C a downward force is then applied to lift handle 141 and lift body frame 146. Referring to FIG. 25D, downward force causes lift handle 141, set plate 165, lock pin 177, and lift body frame 146 to rotate downward, as hydraulic strut 150 is compressed.

Figure 25E:
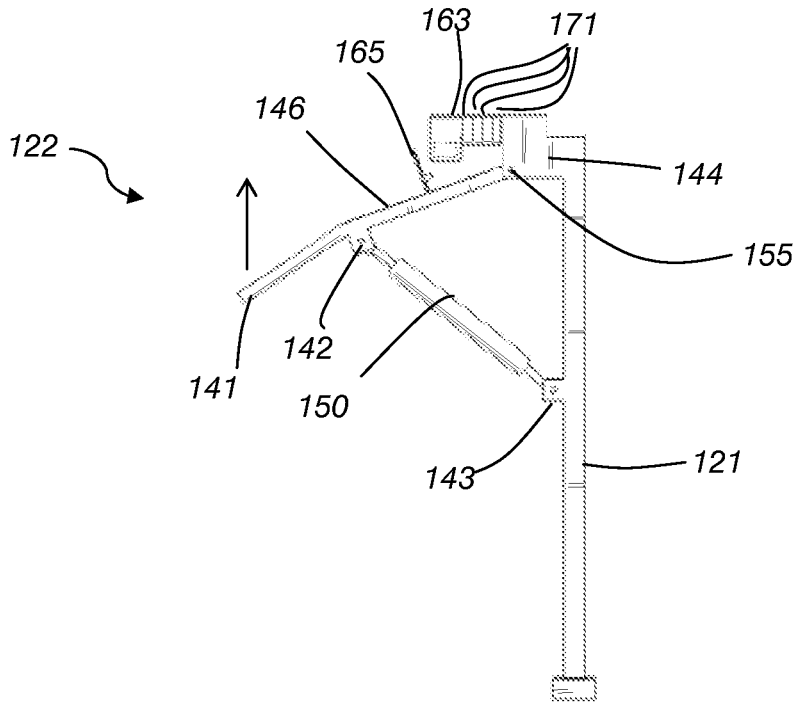
FIG. 25E is a partial cross-sectional side view of a lifting means, showing replacement of a sliding spacer, according to the embodiment of FIG. 1.

Referring to FIG. 25E, roller housing 163 and slide rail 161*a* is pushed backwards, away from housing member 144. The removed spacing slider 171 is replaced into position on slide rail 161. Hydraulic strut 150 decompresses, causing lift handle 141, set plate 165, lock pin 177, and lift body frame 146 to rotate upwards.

Figure 25F:
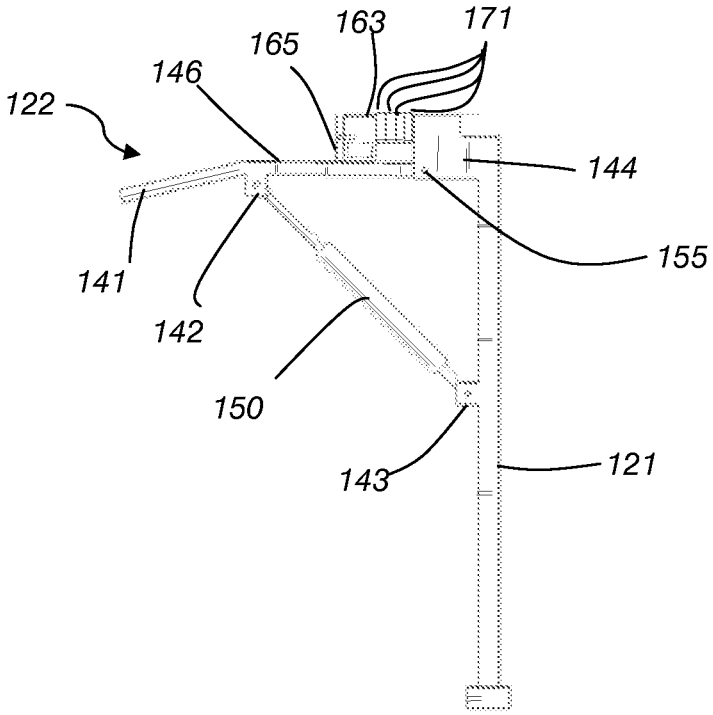
FIG. 25F is a partial cross-sectional side view of a lifting means, showing the lifting means in a locked position, according to the embodiment of FIG. 1.

Referring to FIG. 25F, lift handle 141, set plate 165, lock pin 177, and lift body frame 146 then rise back to resting position.

Figure 26:
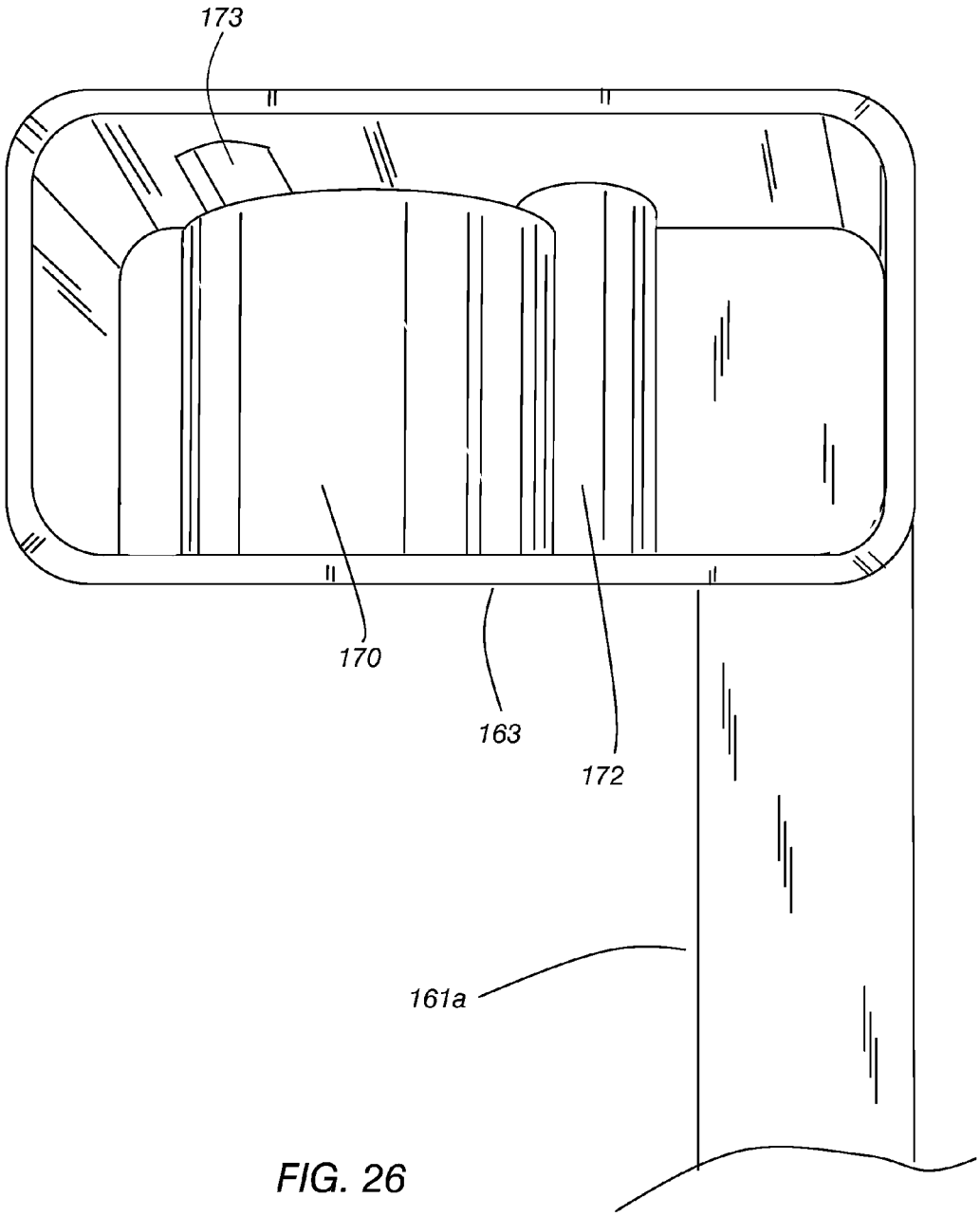
FIG. 26 is a top view of a roller housing, according to the embodiment of FIG. 1.

FIG. 26 illustrates a top view of roller housing member 163, when lift handle 141, set plate 165, lock pin 177, and lift body frame 146 are axially rotated downward (as shown in FIG. 25D and FIG. 25E). Roller 170 rests against set pin 172 and lower surface of roller housing member 163.

Figure 27:
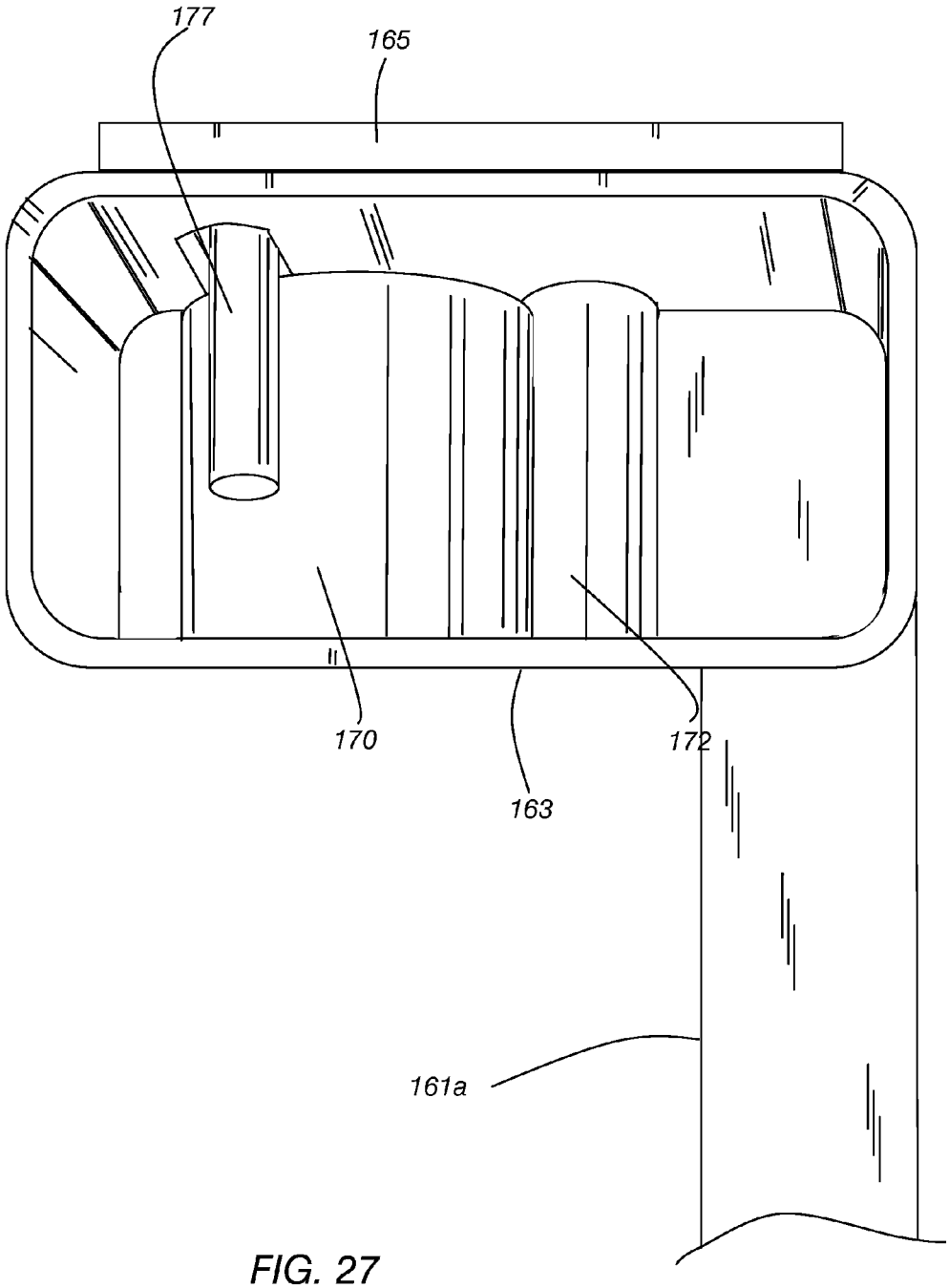
FIG. 27 is a top view of a roller housing, showing engagement of a locking pin and a set plate, according to the embodiment of FIG. 1.
Figure 28:
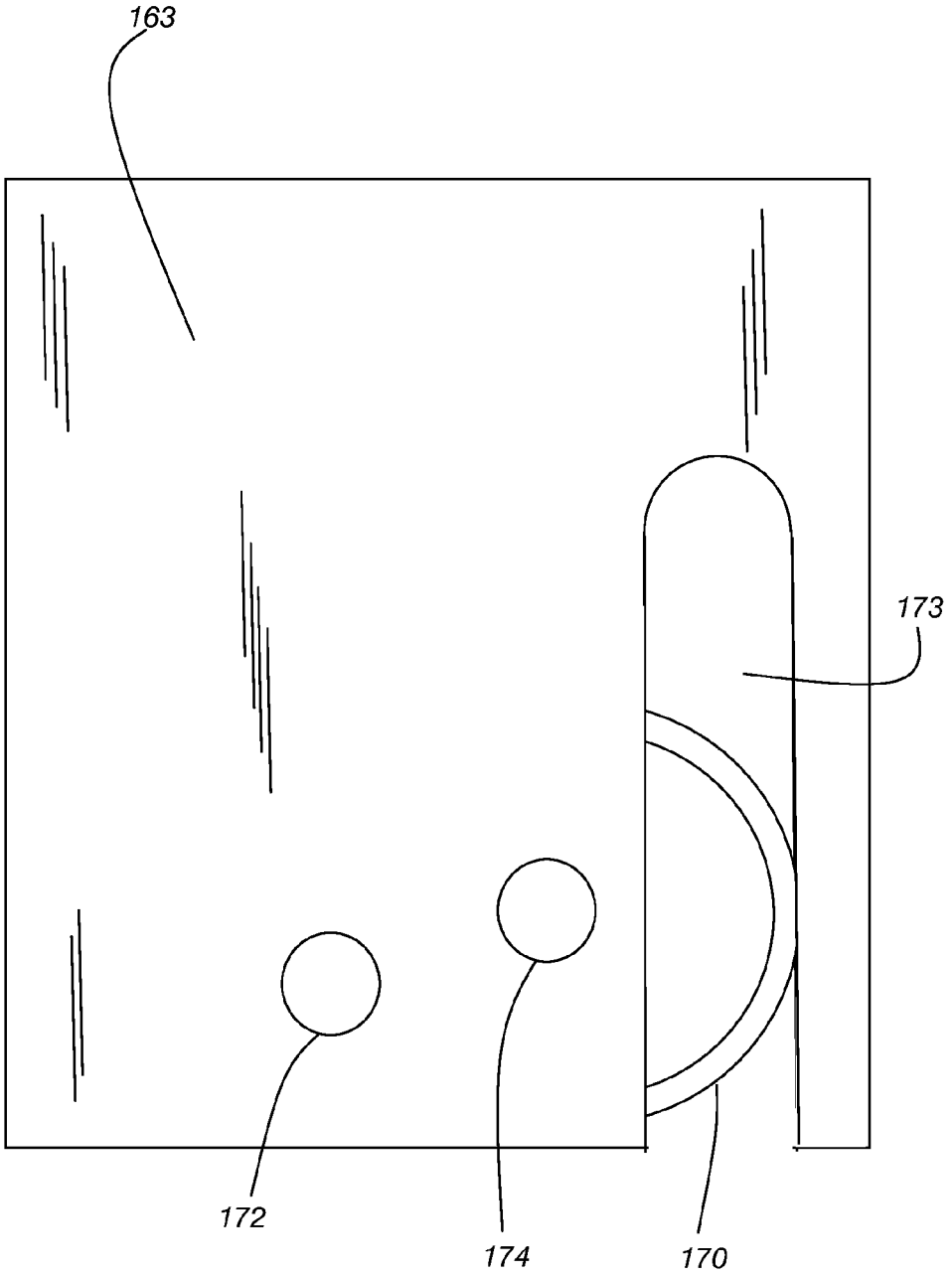
FIG. 28 is a front view of a roller housing, according to the embodiment of FIG. 1.
Figure 29:
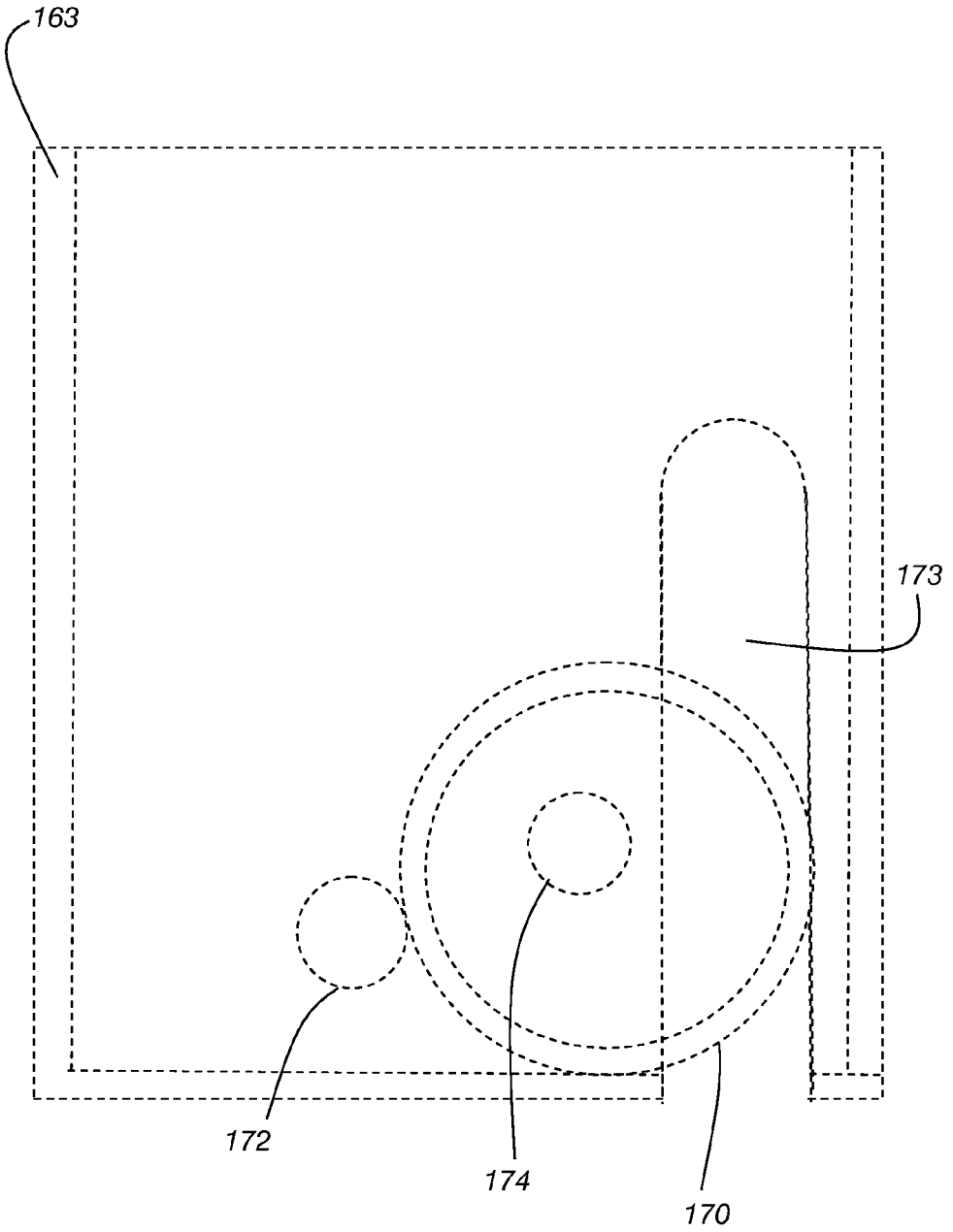
FIG. 29 is a front cross-sectional view of a roller housing, according to the embodiment of FIG. 1.
Figure 30:
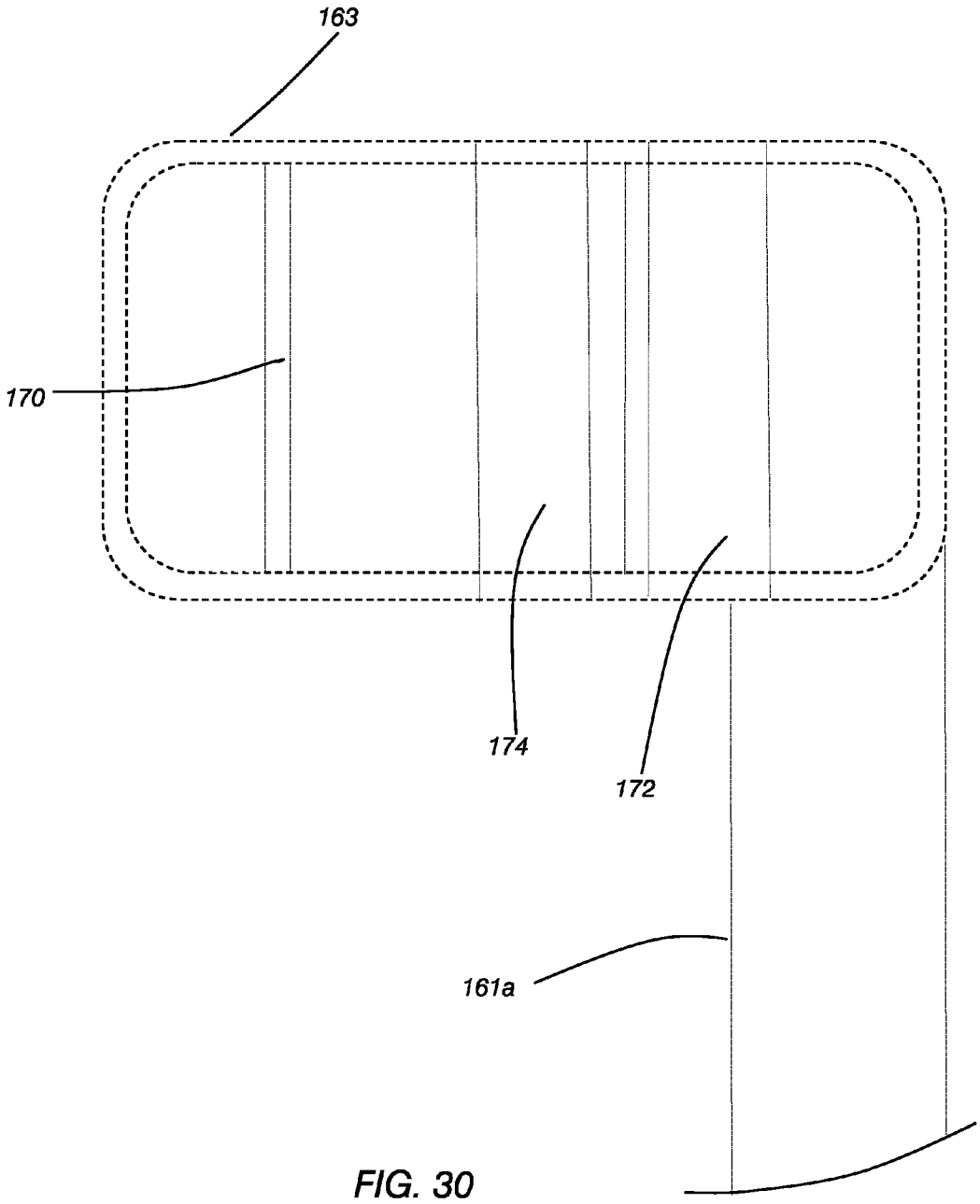
FIG. 30 is a top cross-sectional view of a roller housing, according to the embodiment of FIG. 1.
Figure 31:
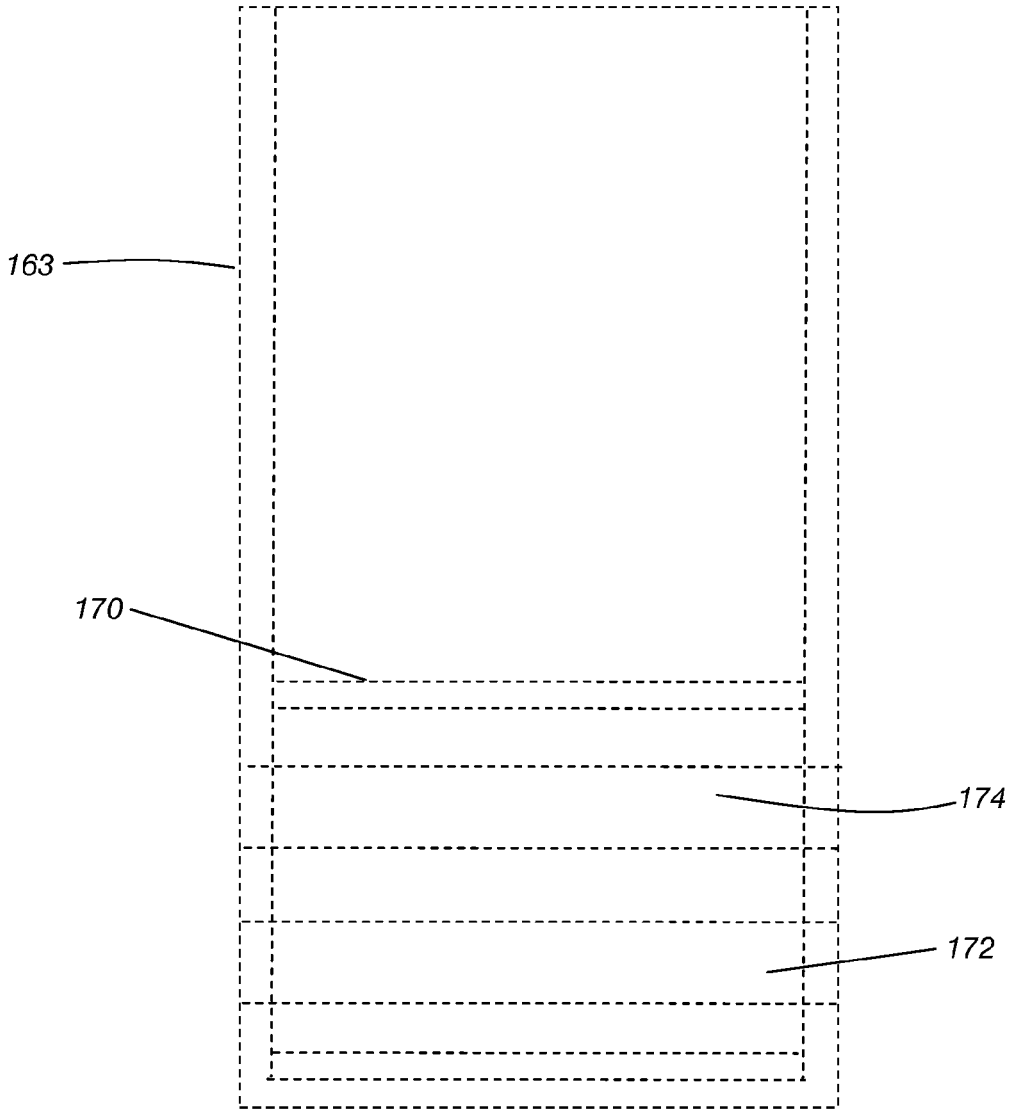
FIG. 31 is a side cross-sectional view of a roller housing, according to the embodiment of FIG. 1.
Figure 32:
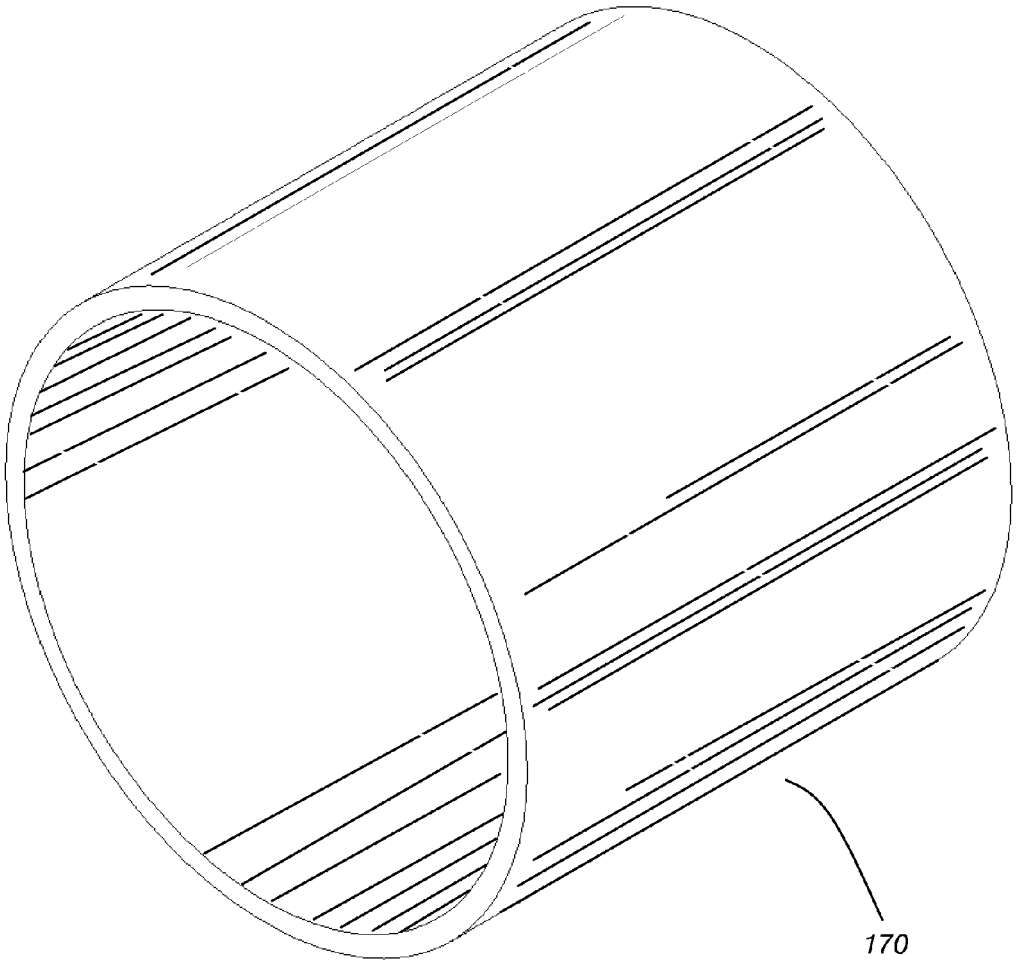
FIG. 32 is a perspective view of a roller, according to the embodiment of FIG. 1.
Figure 33:
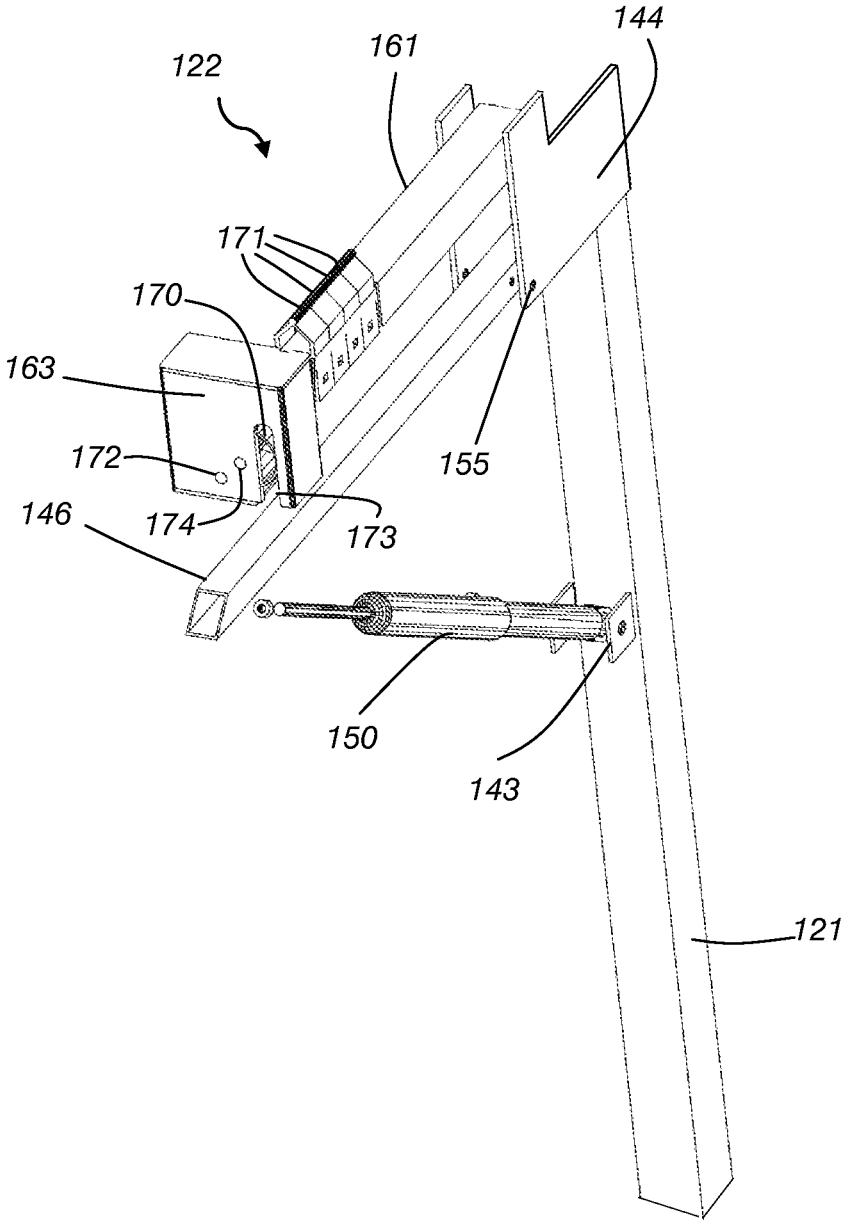
FIG. 33 and FIG. 34 are partial exploded perspective views of a lifting means, according to the embodiment of FIG. 1.
Figure 34:
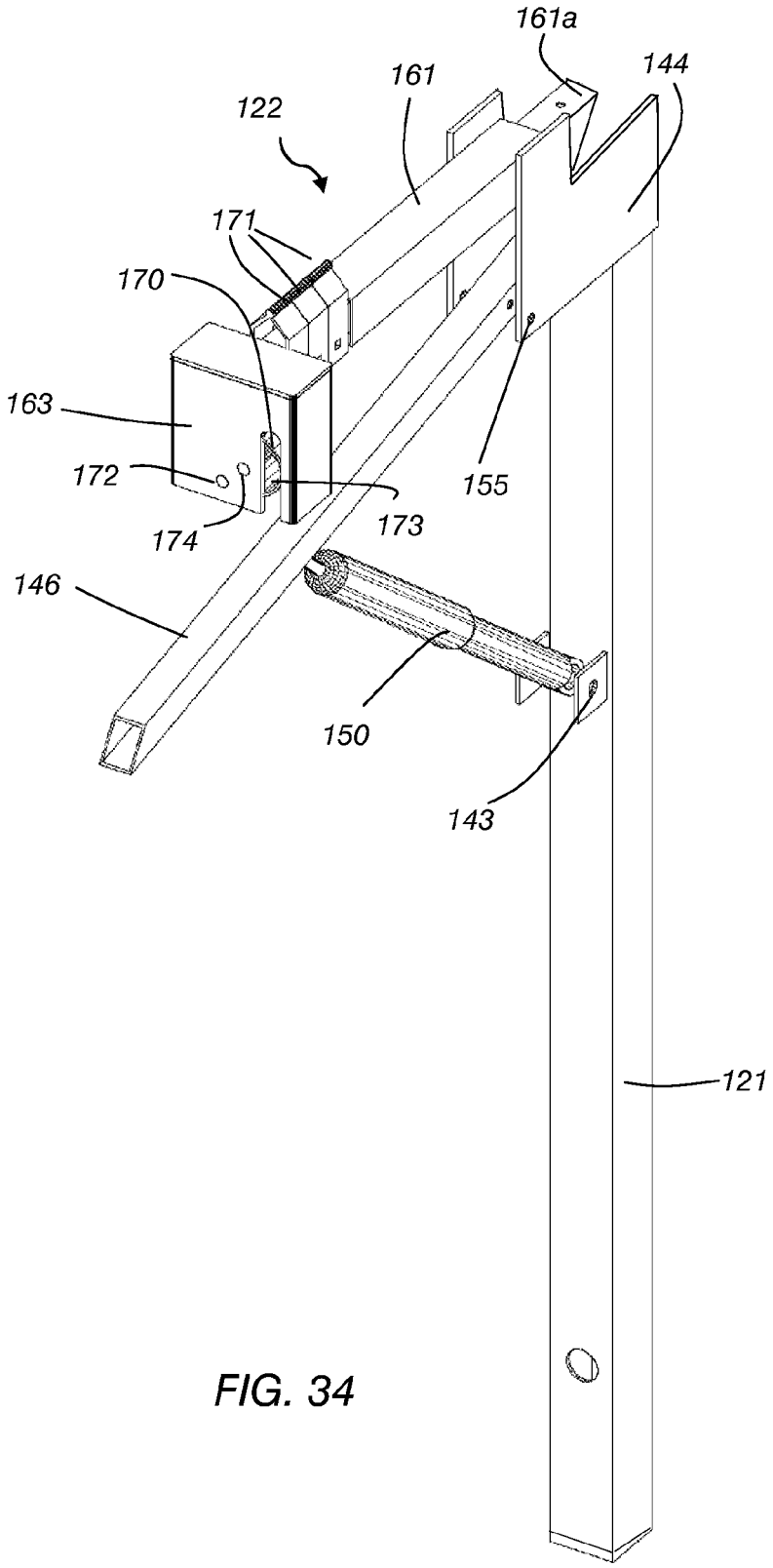
Figure 35:
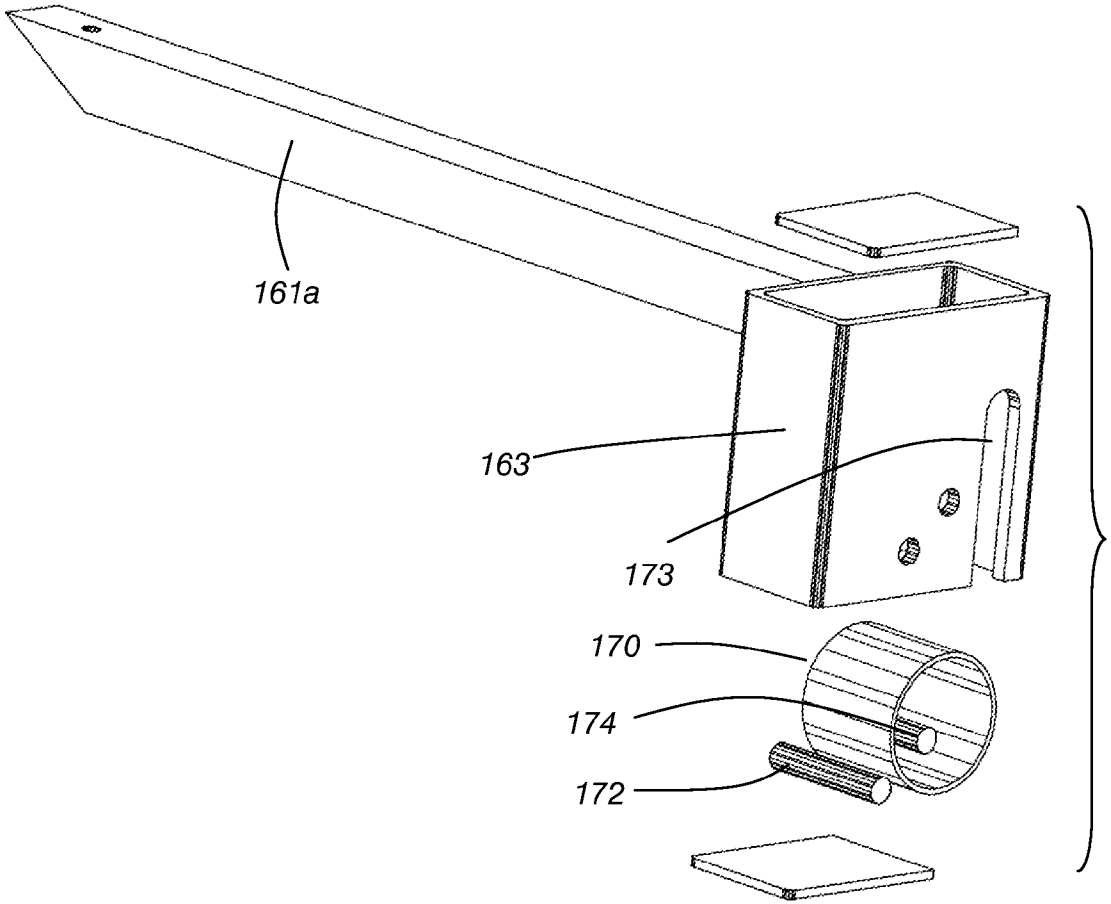
FIG. 35 is an exploded perspective view of a roller housing, according to the embodiment of FIG. 1.
Figure 36:
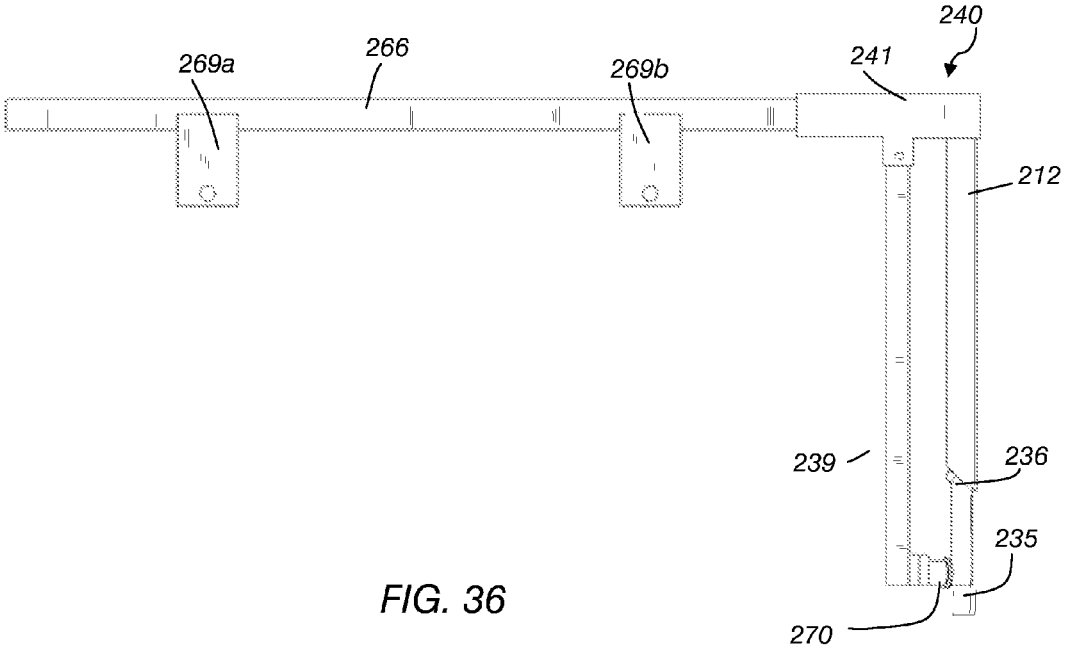
FIG. 36 is a front view of a self-closing entry system of an alternate embodiment of the invention.
Figure 37:
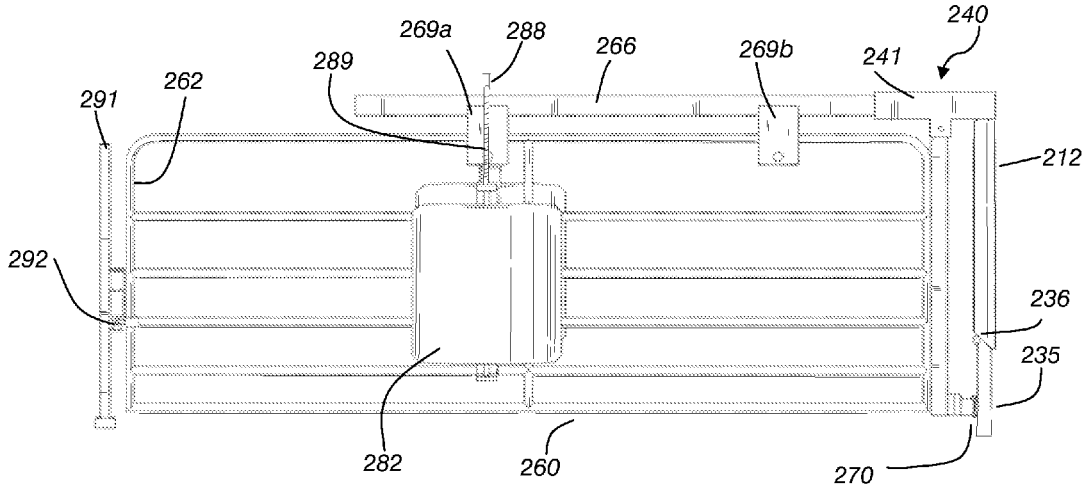
FIG. 37 is a front view of the self-closing entry system, showing a bumper assembly in a first rest position, according to the embodiment of FIG. 36.
Figure 38:
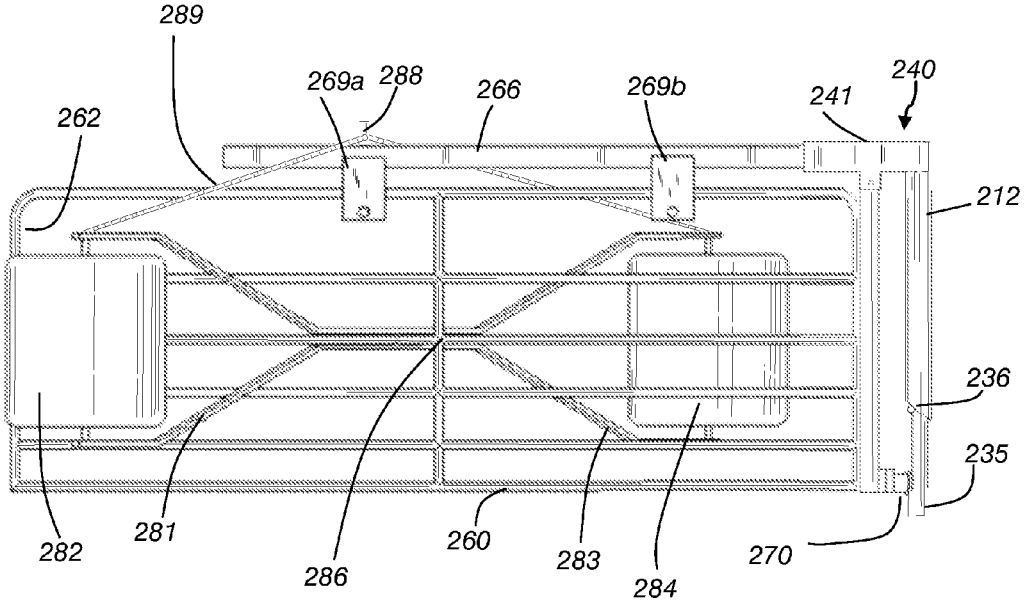
FIG. 38 is a front view of the self-closing entry system, showing a bumper assembly in a second rotatable position, according to the embodiment of FIG. 36.

FIG. 27 illustrates a top view of roller housing member 163, when lift handle 141, set plate 165, lock pin 177, and lift body frame 146 are axially rotated upward and locked (as shown in FIG. 25A, FIG. 25B and FIG. 25F). Roller 170 rests against set pin 172 and lower surface of roller housing member 163. Lock pin 177 extends through recess cavity 173, and rests on upper surface of roller 170. Set plate 165 rests against roller housing member 163. Roller pin 172 and set pin 172, allow rotation of roller 170, however, are spaced such as to prohibit precession of roller 170 over roller pin 172.

Lifting means 122 allows an operator to lock the control structure 120. In the locked position, any type of suitable locking device may be added to spacing sliders 171. Removal of spacing sliders 171 allows roller housing to be extended towards lift housing member 144, causing set plate 165 and lock pin 177 to be released. Rotation of set plate 165 and lock pin 177 is then permitted. The operator then applies a downward force on lift handle 141. The removed spacing sliders 171 (and locking device) are then replaced. The decompression of the hydraulic strut 150 allows the lift handle 141, set plate 165, lock pin 177, and lift body frame 146 to rotate upwards at the rate of decompression of hydraulic strut 150. In the preferred embodiment, the rate of decompression of the hydraulic strut 150 may last up to 10 seconds or more, allowing the operator time to travel through the entrance, before the lifting cable 123 descends.

As the lift handle 141, set plate 165, lock pin 177, and lift body frame 146 rotate upwards, lock pin 177 enters the recess cavity 173, while a horizontal distance exists between set plate 165 and roller housing member 163. Lock pin 177 then travels along outer periphery of roller 170, at the same time set plate 165 ascends towards roller housing member 163. As set plate 165 is raised against roller housing member, lock pin 177 slides on top of roller 170. Lock pin 177 is then locked into position.

Embodiments of the invention may be used for entrance of a vehicle through the self-closing entry system. In the example of passage of a vehicle, the entrance member 60 first exists in a first reset position 1 (as shown in FIG. 5). The vehicle approaches the entrance member 60, and stops such that the driver can reach control structure 120.

Driver engages control structure 120, which lifts first lifting cable 123. Lifting cable 123 causes latch plate 97 to rise, permitting entrance member 60 movement opposing vehicle. Vehicle then moves forward, exerting force 25 against first bumper contact member 82. Lifting means 122 causes lifting cable 123 to descend over a given period of time, allowing vehicle time to ingress and egress through self-closing entry system.

Vehicle continues to move forward, as bumper contact member 82 axially rotates along periphery of vehicle. Second bumper frame member 83 and second bumper contact member 84 rotate in the opposite direction (in relation to first bumper frame member 81 and first bumper contact element 82) such that weight is of bumper assembly 80 is distributed evenly with respect to fulcrum 86, thereby preventing weight from increasing entrance member 60 acceleration towards the vehicle during closing.

Vehicle continues forward, as roller bearing 36 travels along upper cam surface 31, thereby causing entrance member 60 to swing open in relation to upright support post 12. As vehicle continues forward, first bumper contact member 82 rolls against outer periphery of vehicle until vehicle has exited, at which entrance member 60 is in second rotatable position 2 (as shown in FIG. 6).

After vehicle exit, bumper assembly 80 then begins to rotate back to first reset position 1 (as shown in FIG. 7). Even distribution of weight of bumper assembly 80 relative to fulcrum 86 permits bumper assembly 80 to return to first reset position 1 in a controlled manner, without striking the vehicle. Hinge bearing structure 70 limits rate of movement of entrance member 60 relative to upright support 12. Linear bearings 21 further distribute weight of entrance member 60 and attached components across length of upright support post 12. Fluid 28 within upright support post 12, reduces friction.

The advantage of the foregoing structure allows operation in a controlled manner, without damaging the vehicle. The placement, type, and composition of equivalent components can be substituted as necessary to control the rate of axial rotation of entrance member towards a closed position.

As the vehicle approaches the entrance member, the driver may operate the control structure without exiting the vehicle. The entrance member is then unlatched, allowing the driver to move the vehicle forward. The outer periphery of the vehicle exerts a force against a bumper contact element, causing the bumper contact element to axially rotate. Axial rotation of the bumper contact element allows a smooth distribution of force along the bumper assembly. As the pulls forward, the bumper frame member rotates relative to entrance member, further distributing the force of the vehicle.

As one bumper contact element and bumper frame member rotates with the vehicle, the opposing bumper contact element and bumper frame member oppositely rotate with respect to the entrance member. Such opposite rotation distributes the weight of the entire bumper assembly, such that the bumper assembly does not easily return and strike the vehicle.

The hinge bearing arrangement reduces the angular momentum of the entrance member during opening and closing, thereby preventing the bumper assembly from striking the vehicle. Such an arrangement also allows regulated time of the vehicle time for passage.

Incorporation of bearings (such as linear bearings) along the upright support post restricts shearing forces and distributes point loads exerted at the cam surface. The bearings also reduce angular velocity of post member, thereby allowing smooth operating of the entrance member. Fluid within the upright support post reduces friction with the post member.

Opening of the entrance member requires continuous application of a force in a across bumper surfaces. A vehicle must continue to axially rotate the bumper assembly for the entrance member to open. As such, a quick introduction of a force (such as a force introduced by livestock) at the bumper assembly will not cause the entrance member to open. Moreover, bumper surfaces extend in a curvilinear manner, limiting the number of wind catching surfaces.

Figure 39:
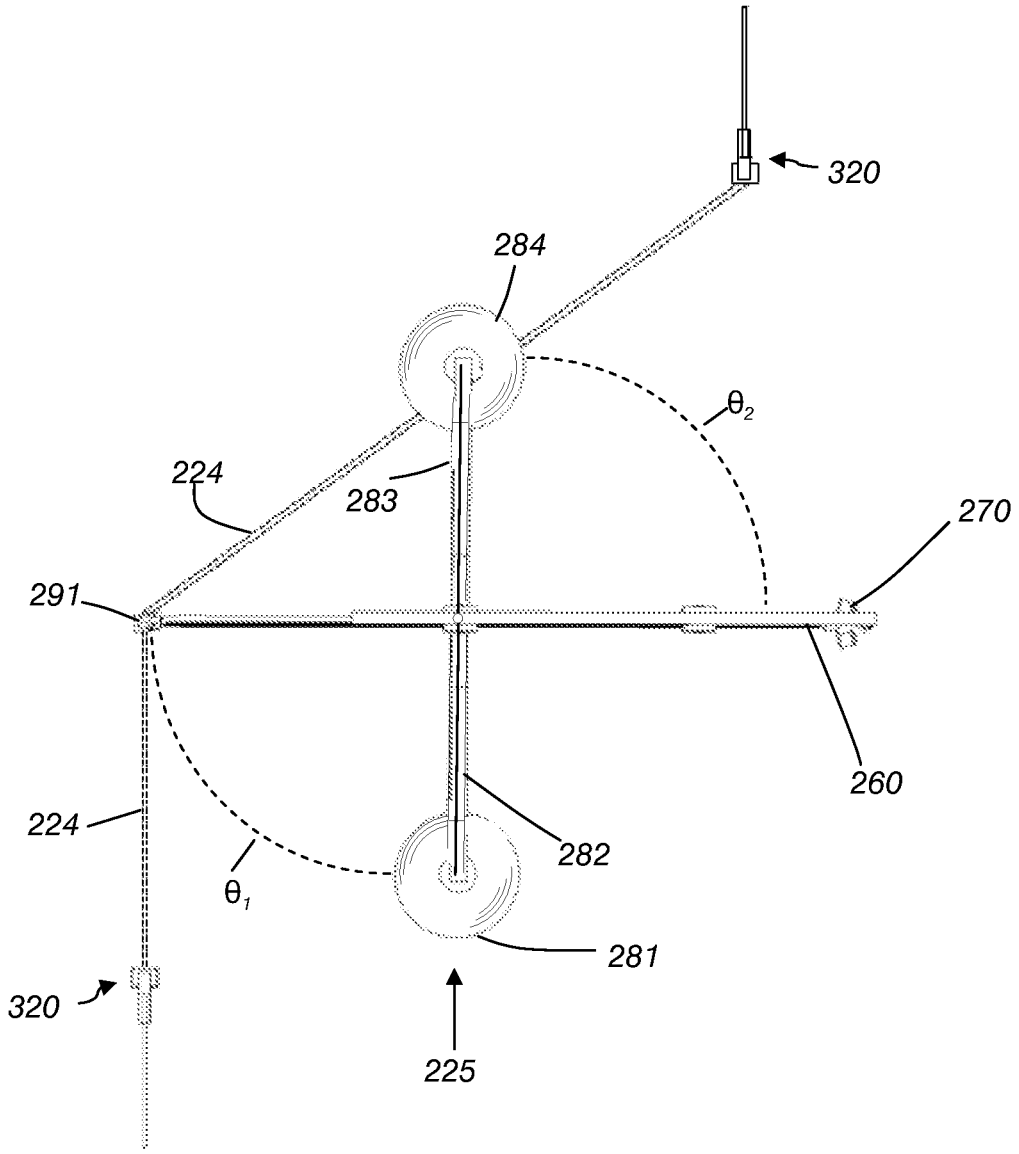
FIG. 39 is a top plan view of the self-closing entry system, showing a bumper assembly in a first reset position, according to the embodiment of FIG. 36.
Figure 40:
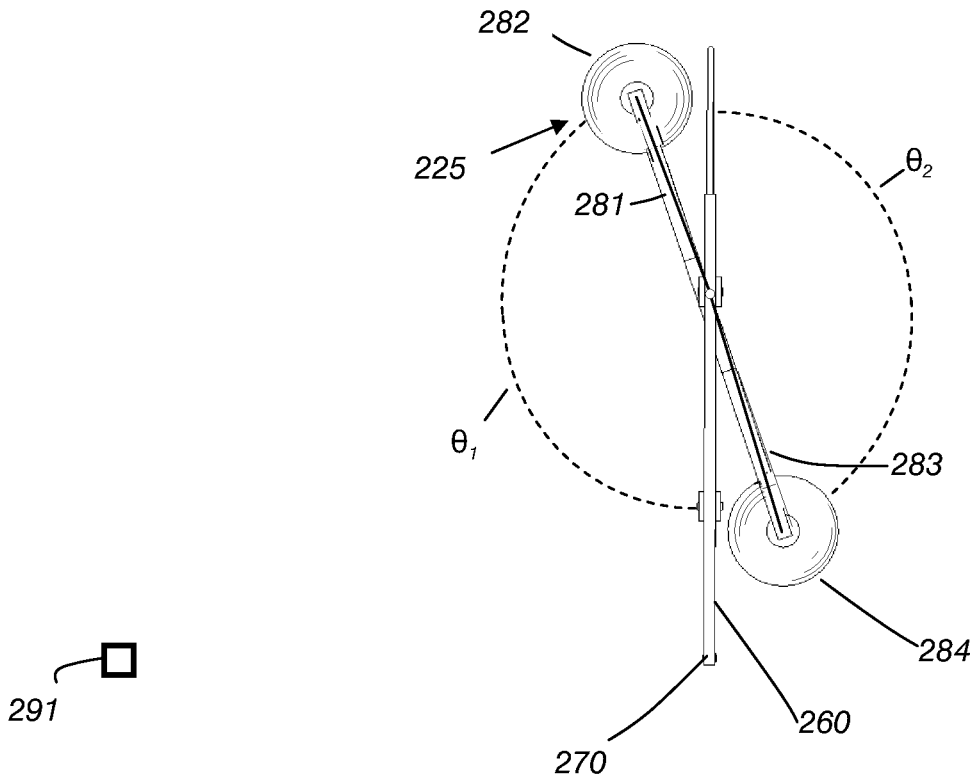
FIG. 40 is a top plan view of the self-closing entry system, showing a bumper assembly in a second rotatable position, according to the embodiment of FIG. 36.
Figure 41:
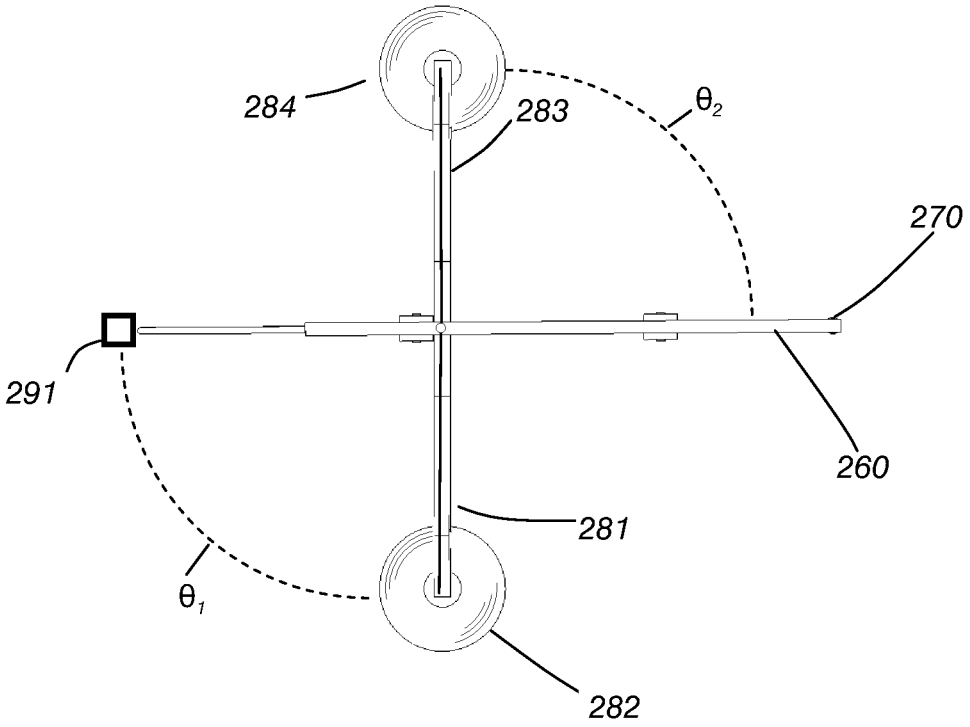
FIG. 41 is a top plan view of the self-closing entry system, showing a bumper assembly in a first reset position, according to the embodiment of FIG. 36.
Figure 42:
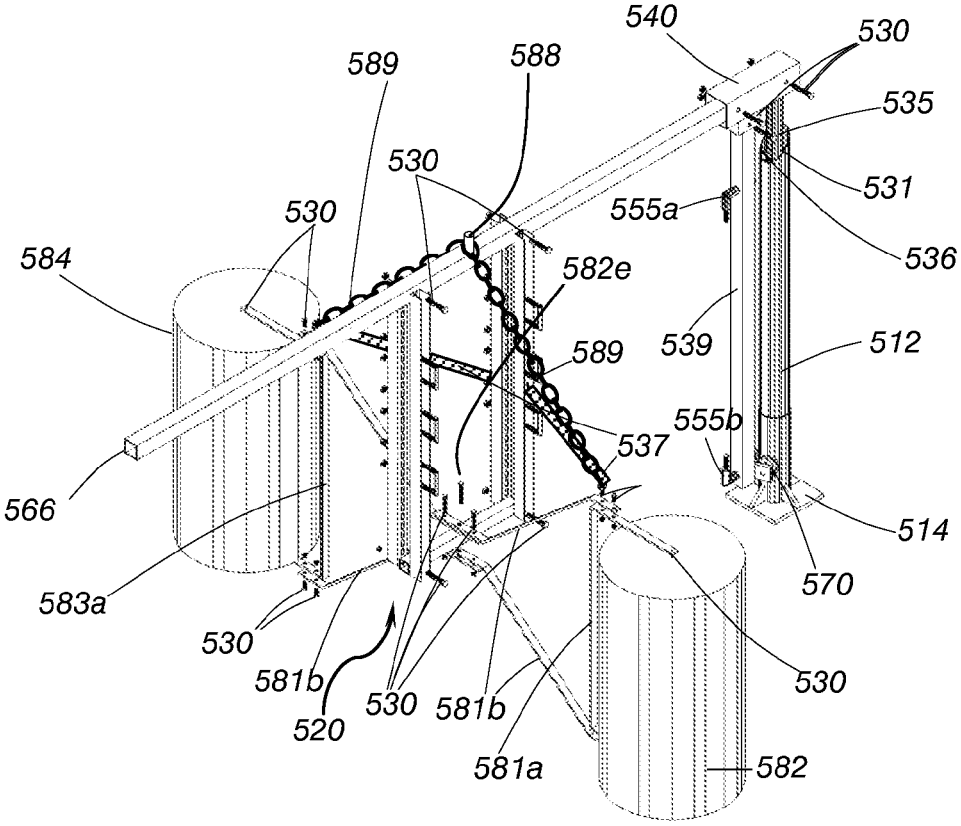
FIG. 42 is a partially exploded perspective view of a self-closing entry system without a latching means attached, of an alternate embodiment of the invention.
Figure 43:
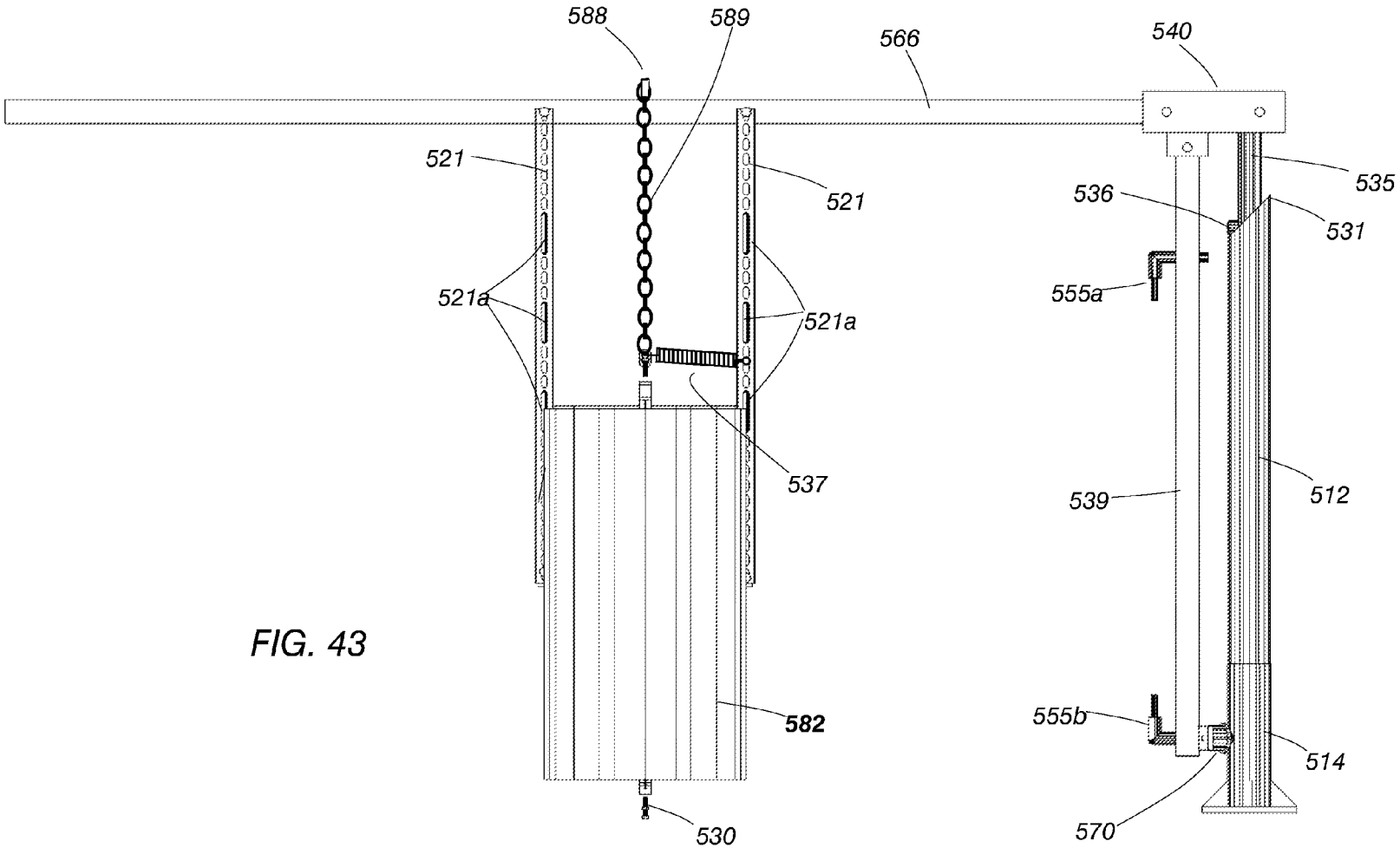
FIG. 43 is a front view of a self-closing entry system without a latching means attached, according to the embodiment of FIG. 42.
Figure 44:
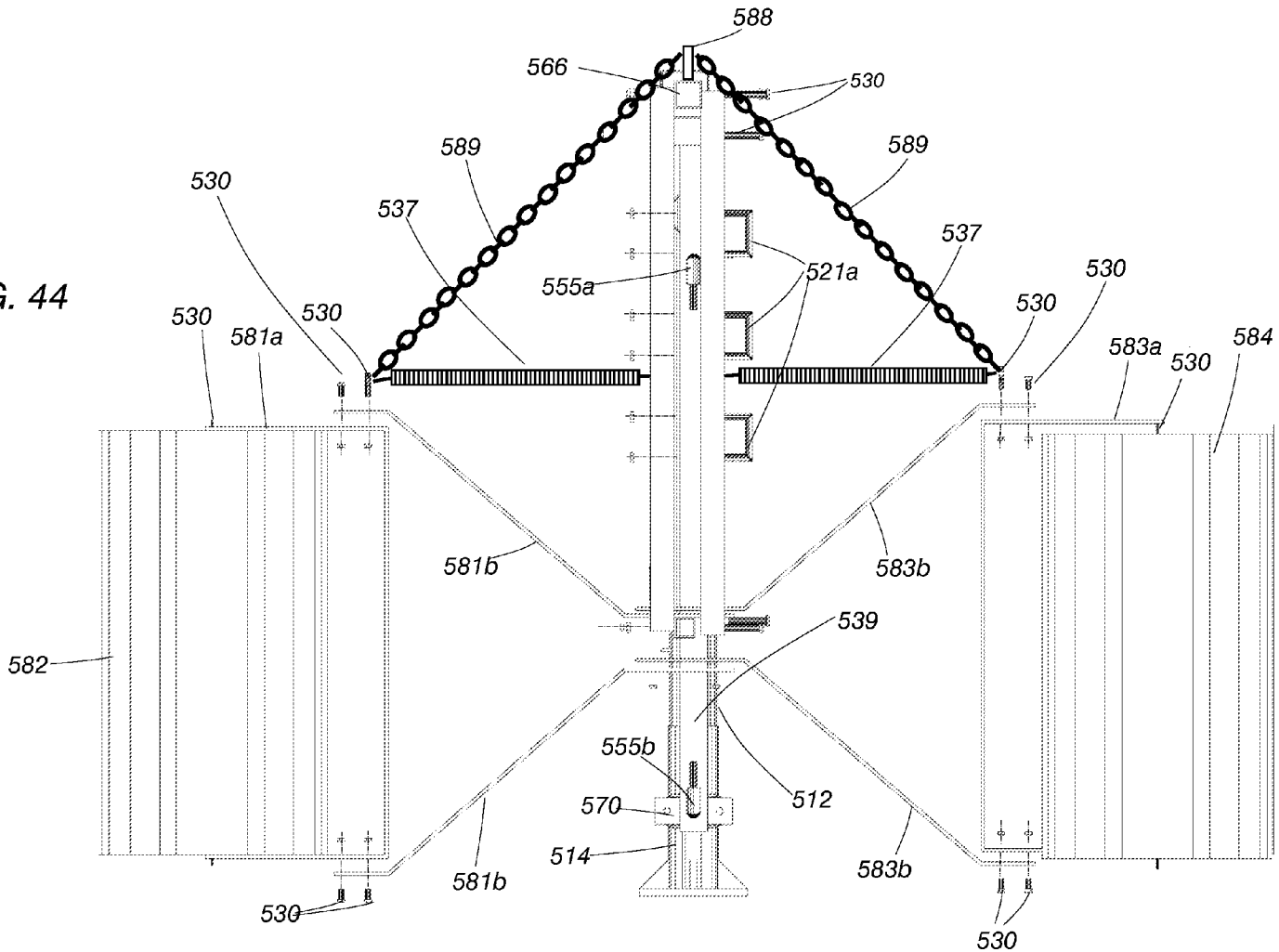
FIG. 44 is a partially exploded side view of a self-closing entry system without a latching means attached, according to the embodiment of FIG. 42.
Figure 45:
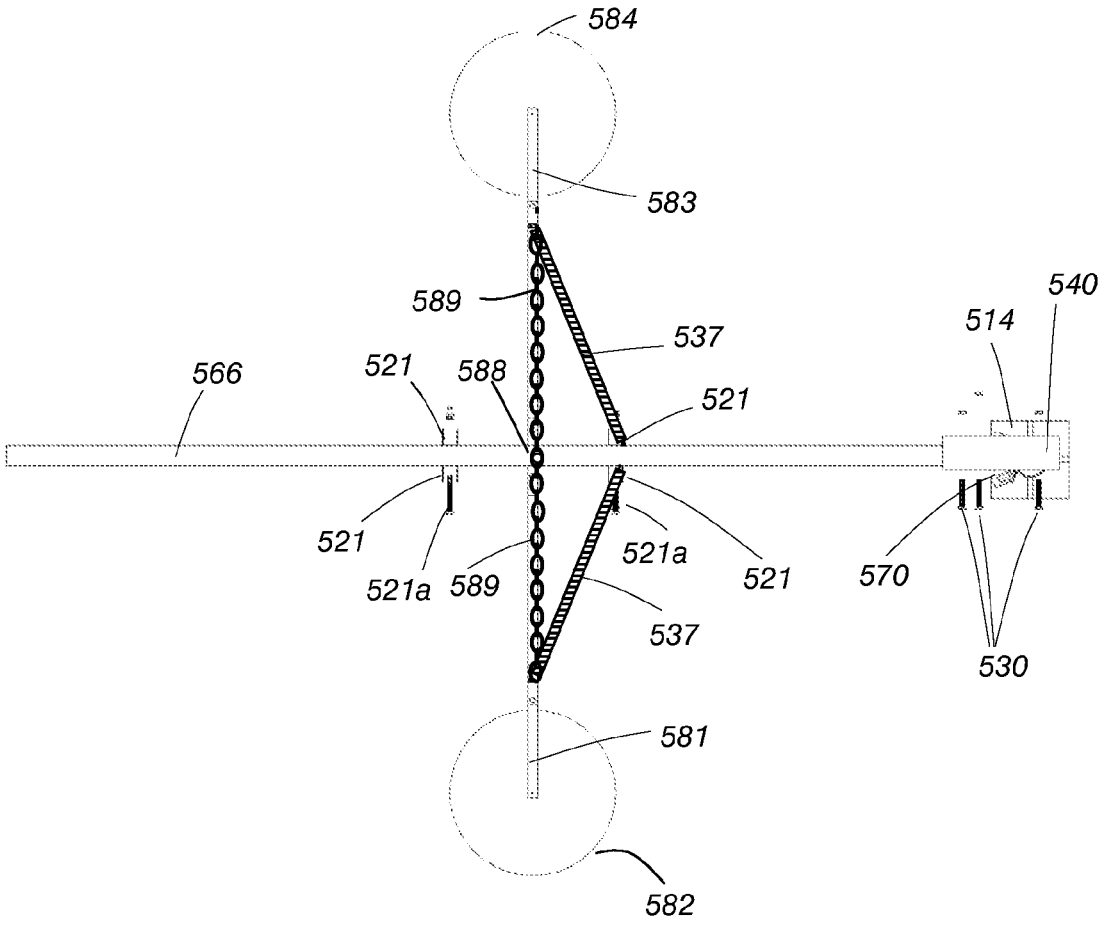
FIG. 45 is a partially exploded top plan view of a self-closing entry system without a latching means attached, according to the embodiment of FIG. 42.

Referring to FIGS. 36-41, a self-closing entry system in accordance with a further embodiment of the invention is illustrated. According to the embodiment, entrance member 260, entrance support arm 266, attachment plates 266*a*, 266*b*, hinge post 239, hinge bearing structure 270, first bumper frame member 281, first bumper contact element 282, second bumper frame member 283, second bumper contact element 284, fulcrum 286, latching post 291, mechanical latch 292, control structure 220, and lifting cable housing 224 are as described according to the preferred embodiment. Post member 235 extends longitudinally perpendicular with the ground, and has a roller bearing 236 affixed to a lower surface of post member 235. Support post 212 circumposes post member 235 and extends into receiver coupler element 240. Receiver coupler element 240 has a receiver body 241. Application of a force 225 causes movement between a first reset position 1 and second rotatable position 2, as shown in FIGS. 39-41.

Referring to FIGS. 42-45, a self-closing entry system in accordance with a further embodiment of the invention is illustrated. The embodiment has foundation member 514, upright support post 512, upper cam surface 531, post member 535, receiver member 540, hinge post 539, hinge bearing structure 570, attachment means 555*a*, 555*b*, first bumper frame member 581, first bumper contact element 582, second bumper frame member 583, second bumper contact element 584, counter-balance assembly 598, pivot member 588, reset mechanism 537, and bumper hanging assembly 520 as shown in FIGS. 42-45. Bumper hanging assembly 520 comprises one or more support members 521, depending from support arm 566. Support members 521 are attached to support arm via set bolts 530. One or more U-Bolt members 521*a* may fixably attach entrance an entrance member 560 to support members 521. Cross-beam member 522 extends longitudinally between support members 521, providing longitudinal support. One or more set bolts 530 may be used for attachment. First and second Bumper frame members 581, 584 have one or more upright frame members 581*a*, 583*a*, and one or more traverse members 581*b*, 583*b*. A clevis pin 582*e* rotatably attaches first and second bumper frame members 581, 584 to cross-beam member 522. The embodiment may be used in connection with a latching means 90 and latching control means 100, as set forth in the preferred embodiment.

Any element in a claim that does not explicitly state "means for" performing a specified function, or "step for" performing a specific function, is not to be interpreted as a "means" or "step" clause as specified in 35 U.S.C. §112, ¶ 6. In particular, the use of "step of" in the claims herein is not intended to invoke the provisions of 35 U.S.C. §112, ¶ 6.

What is claimed is:

1. A self-closing entry system comprising:

an entrance;

an upright support post located at one side of said entrance, said upright support post having an at least one upper cam surface;

a post member concentrically disposed within said upright support post at one end of said post member and an opposing end of said post member extends into a receiver member, said post member having at least one roller bearing, said at least one roller bearing slides along said at least one upper cam surface as a cam follower during opening and closing of said self-closing entry system, the roller bearing disposed on the post member, and wherein the roller bearing rides on the upper cam surface that is disposed directly onto the upright support post;

a hinge post extending parallel to said upright support post and one end of said hinge post extends into said receiver member;

an entrance member pivotably mounted to said upright support post and extending into said receiver member;

a hinge bearing structure attached to said hinge post, wherein said hinge bearing structure, said hinge post, and said post member rotate about said upright support post and said hinge bearing structure rides along an outer surface of said upright support post during said opening and closing of said self-closing entry system, and wherein the hinge bearing structure mounted onto the hinge post has a bearing surface that engages said outer surface of the upright support post, where in the post member, the hinge post, and the hinge bearing structure are rotatable with respect to the upright support post;

a bearing arrangement positioned between said upright support post and said post member, such that said bearing arrangement is concentrically disposed within said upright support post;

a bumper assembly comprising a first bumper frame member attached to a fulcrum, a first bumper contact element capable of independent axial rotation in relation to said first bumper frame member, a second bumper frame member attached to said fulcrum, a second bumper contact element capable of independent axial rotation in relation to said second bumper frame member, wherein said first bumper frame member and said second bumper frame member comprise a contiguous longitudinally extending assembly, forming a lever capable of pivoting about said fulcrum;

a counter-balance assembly, causing said first bumper frame member and said second bumper frame member to rotate in opposite direction, said counter-balance assembly further causing said first bumper frame member to maintain a first central angle between said first bumper frame member and said entrance member which is approximately equivalent to a second central angle between said second bumper frame member and said entrance member during said opening and closing of said self-closing entry system, wherein application of a force against said bumper assembly pivotably rotates said bumper assembly about said fulcrum from a first reset position to a second rotatable position thereby moving said self-closing entry system to an open position of;

a reset mechanism urging said bumper assembly to rotate from said second rotatable position to said first reset position when said force is removed from said bumper assembly;

a latching structure; and a latching control.

2. The self-closing entry system of claim 1, wherein said bearing arrangement comprises a linear bearing.

3. The self-closing entry system of claim 1, wherein said bearing arrangement is: a plain bearing, a rolling element bearing, a jewel bearing, or a fluid bearing.

4. The self-closing entry system of claim 1, wherein said bearing arrangement comprises three linear bearings offset from each other within said upright support post by a plurality of spacers.

5. The self-closing entry system of claim 1, wherein said hinge bearing structure comprises a support strut fixedly attached to said hinge post, a pair of linear ball transfer bearings fixedly attached to said support strut, wherein said support strut has longitudinally extending frame bars forming a dihedral angle about a central surface of said support strut, said pair of linear ball transfer bearings fixedly attached to said longitudinally extending frame bars.

6. The self-closing entry system of claim 1, wherein said upright support post is filled with a fluid.

7. The self-closing entry system of claim 6, wherein said entrance member is attached to said hinge post by a fastening structure.

8. The self-closing entry system of claim 7, wherein said fastening structure comprises a set of brackets and set screws.

9. The self-closing entry system of claim 1, wherein said counter-balance assembly extends between said first bumper frame member and said second bumper frame member and through a pivot member.

10. The self-closing entry system of claim 9, wherein said counter-balance assembly is a chain.

11. The self-closing entry system of claim 9, wherein said counter-balance assembly is a system of elastic cables.

12. The self-closing entry system of claim 1, wherein said latching structure comprises a latching post, a mechanical latch, a latch pin housing, and a latch pin.

13. The self-closing entry system of claim 1, wherein said latching control has at least one control structure.

14. The self-closing entry system of claim 13, wherein said at least one control structure comprises a control post, a lifting system, a lifting cable, and a lifting cable housing.

15. A self-closing entry system comprising:

an entrance;

an upright support post located at one side of said entrance;

a post member concentrically disposed within said upright support post;

a bearing arrangement facilitating rotation of said self-closing entry system as said self-closing entry system rotates between open and closed positions, said bearing arrangement includes a cam surface and roller bearing;

said roller bearing disposed on the post member, wherein the roller bearing rides on the cam surface that is disposed directly onto the upright support post;

an entrance member pivotably mounted to said upright support post via said post member, wherein said bearing arrangement is capable of regulating a time of travel of said entrance member between said open and closed positions of said self-closing entry system;

a hinge post extending parallel with said upright support post;

a hinge bearing structure attached to said hinge post, wherein said hinge bearing structure, said hinge post, and said post member rotate about said upright support post and said hinge bearing structure rides along an outer surface of said upright support post during opening and closing of said self-closing entry system, and wherein the hinge bearing structure mounted onto the hinge post has a bearing surface that engages said outer surface of the upright support post, where the post member, the hinge post, and the bearing arrangement rotate with respect to the upright support post;

a bumper assembly defined by at least one bumper frame member pivotably fastened to said entrance member at a fulcrum and at least one bumper contact element fastened to said at least one bumper frame member, and wherein said at least one bumper contact element is capable of axial rotation with respect to said at least one bumper frame member;

wherein application of a force against said at least one bumper contact element pivotably rotates said at least one bumper frame member about said fulcrum from a first reset position to a second rotatable position thereby moving said self-closing entry system to said open position; and wherein removal of said force against said at least one bumper contact element allows said at least one bumper frame member to pivotably rotate from said second rotatable position to said first reset position, thereby moving said self-closing entry system said a closed position.

* * * * *